US005385796A

United States Patent [19]

Spiewak et al.

[11] Patent Number: 5,385,796

[45] Date of Patent: Jan. 31, 1995

[54] ELECTROPHOTOGRAPHIC IMAGING MEMBER HAVING UNMODIFIED HYDROXY METHACRYLATE POLYMER CHARGE BLOCKING LAYER

[75] Inventors: John W. Spiewak, Webster; Huoy-Jen Yuh, Pittsford; Constance J. Thornton, Ontario; Dennis A. Abramsohn, Pittsford; Deborah Nichol-Landry, Rochester; Joseph Mammino, Penfield; Ronald F. Ziolo; Robert C. U. Yu, both of Webster; Kathleen Carmichael, Williamson; Neil S. Patterson, Pittsford, all of N.Y.

[73] Assignee: Xerox Corporation, Stamford, Conn.

[21] Appl. No.: 860,396

[22] Filed: Mar. 30, 1992

Related U.S. Application Data

[63] Continuation-in-part of Ser. No. 691,180, Apr. 25, 1991, abandoned, which is a continuation of Ser. No. 458,916, Dec. 29, 1989, abandoned.

[51] Int. Cl.[6] ..... G03G 5/14; G03G 5/05

[52] U.S. Cl. ..... 430/64; 430/58; 430/126; 430/131

[58] Field of Search ..... 430/64, 58, 131, 54, 430/126

[56] References Cited

U.S. PATENT DOCUMENTS

| | | | |
|---|---|---|---|
| 2,901,348 | 8/1959 | Dessauer et al. | 96/1 |
| 3,113,022 | 12/1963 | Cassiers et al. | 96/1 |
| 3,245,833 | 4/1966 | Trevoy | 117/201 |
| 3,295,967 | 1/1967 | Schoenfeld | 96/1.5 |
| 3,355,742 | 11/1967 | Staubli | 346/49 |
| 3,428,451 | 2/1969 | Trevoy | 96/1 |
| 3,640,708 | 2/1992 | Humphries et al. | 96/1.5 |
| 3,745,005 | 7/1973 | Yoerger et al. | 96/1.5 |
| 3,932,179 | 1/1976 | Perez-Albuerne | 96/1.5 |
| 4,082,551 | 4/1978 | Steklenski et al. | 96/1 PC |
| 4,256,822 | 3/1981 | Tarumi et al. | 430/62 |
| 4,262,053 | 4/1981 | Burwasser | 428/327 |
| 4,281,055 | 7/1981 | Moriguchi et al. | 430/60 |
| 4,410,614 | 10/1983 | Lelental et al. | 430/45 |
| 4,464,450 | 8/1984 | Teuocher | 430/59 |
| 4,465,751 | 8/1984 | Kawamura et al. | 430/64 |
| 4,485,161 | 11/1984 | Scozzafava et al. | 430/64 |
| 4,500,620 | 2/1985 | Ohishi | 430/60 |
| 4,584,253 | 4/1986 | Lin et al. | 430/59 |
| 4,822,705 | 4/1989 | Fukagai et al. | 430/60 |

FOREIGN PATENT DOCUMENTS

| | | |
|---|---|---|
| 2551018 | 8/1976 | Germany . |
| 3325443 | 1/1984 | Germany . |
| 58-152253 | 9/1983 | Japan . |
| 63-318566 | 12/1988 | Japan . |
| 2009600 | 4/1982 | United Kingdom . |

OTHER PUBLICATIONS

Translation of JP 63-318566 (1988).

Koji Abe, Mikio-Koide and Eishum Tcuchida, Macromolecules 10 (6), 1259-1264 (1977).

M. M. Coleman and D. J. Skrovanek, Conference Proceeding of 44th ANTEC, 321-2 (1986).

*Primary Examiner*—Christopher D. Rodee

[57] ABSTRACT

An electrophotographic imaging member containing a supporting substrate having an electrically conductive surface comprising charge injecting material, a charge blocking layer including a water insoluble high molecular weight unmodified hydroxy methacrylate polymer and at least one photoconductive layer, the charge blocking layer having a surface resistivity greater than about $10^{10}$ ohm/sq. This imaging member may be employed in an electrostatographic imaging process.

23 Claims, No Drawings

ELECTROPHOTOGRAPHIC IMAGING MEMBER HAVING UNMODIFIED HYDROXY METHACRYLATE POLYMER CHARGE BLOCKING LAYER

BACKGROUND OF THE INVENTION

This application is a continuation-in-part of copending application Ser. No. 07/691,180, filed Apr. 25, 1991 now abandoned which is a continuation of application Ser. No. 07/458,916 filed Dec. 29, 1989 now abandoned in the names of John W. Spiewak, Huoy-Jen Yu, Constance J. Thornton, Dennis A. Abramsohn, Deborah Nichol-Landry, Joseph Mammino, Ronald F. Ziolo, Robert C. U. Yu, Kathleen Carmichael and Neil S. Patterson. The entire disclosures of application Ser. Nos. 07/691,180 and 07/458,916 are incorporated herein by reference.

This invention relates in general to electrostatography and, more specifically, to a novel photoconductive device and process for using the device.

In the art of xerography, a xerographic plate containing a photoconductive insulating layer is imaged by first uniformly electrostatically charging its surface. The plate is then exposed to a pattern of activating electromagnetic radiation which selectively dissipates the charge in the illuminated areas of the photoconductive insulator while leaving behind an electrostatic charge pattern in the nonilluminated areas. This resulting electrostatic latent image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer sandwiched between the contiguous charge transport layer and a supporting conductive layer, the outer surface of the charge transport layer is normally charged with a uniform charge of a negative polarity and the supporting electrode is utilized as an anode. Obviously, the supporting electrode may also function as an anode when the charge transport layer is sandwiched between the anode and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers (CGL) and charge transport layers (CTL) have been investigated. For example, the photosensitive member described in U.S. Pat. No. 4,265,990 utilizes a charge generating layer in contiguous contact with a charge transport layer comprising a polycarbonate resin and one or more of certain diamine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed, for example, in U.S. Pat. No. 4,265,990. Additional examples of binder materials such as poly(hydroxyether) resins are taught in U.S. Pat. No. 4,439,507. The disclosures of the aforesaid U.S. Pat. Nos. 4,265,990 and 4,439,507 are incorporated herein in their entirety. Photosensitive members having at least two electrically operative layers as disclosed above provide excellent images when charged with a uniform negative electrostatic charge, exposed to a light image and thereafter developed with finely divided electroscopic marking particles. However, when the supporting conductive substrate comprises a charge injecting metal or non-metal, difficulties have been encountered with these photosensitive members due to discharge in the dark. More specifically, these photosensitive members do not retain sufficient charge during the charging and subsequent imaging exposure and development steps. Most metallic ground planes have a natural oxide layer which inhibits charge injection. Typical metals of this type are aluminum, zirconium, titanium and the like. Some exceptions are metals that do not oxidize such as the noble metals, e.g., gold, platinum and the like that promote charge injection. Ground planes containing other materials such as copper iodide or carbon black also inject charge into charge generation layers so the photoreceptor does not effectively hold charge during the charging, image exposure and/or development steps. Copper iodide ground planes as disclosed in, for example, U.S. Pat. No. 4,082,551 encounter degradation problems during cycling. Charge blocking layers are frequently used on metallized or other kinds of ground planes to inhibit charge injection. Some charge blocking layers require an additional adhesive layer between the charge generation layer and the conductive ground plane. When attempts are made to use resins as a blocking layer, the photoreceptors usually exhibit increased residual charge with cycling. Failure to effectively hold charge during the image exposure and development steps or increased residual charge formation with cycling cannot normally be tolerated in precision copiers, duplicators, and printers.

Copolymers of methyl vinyl ether and maleic anhydride such as the Gantrez AN resins from GAF Corporation have been utilized in blocking layers. Unfortunately, these copolymers of methyl vinyl ether and maleic anhydride are sensitive to water and rapidly hydrolyze to form acidic products which are corrosive and attack metal ground planes of photoreceptors during electrical cycling. Loss of the ground plane due to corrosion during electrical cycling eventually prevents an electrophotographic imaging member from discharging. This is manifested by an increase in background toner deposits in the final image during electrical cycling. In addition, the mechanical properties of copolymers of methyl vinyl ether and maleic anhydride are affected at high humidity and cause flexible electrophotographic imaging members to delaminate. Under low humidity conditions, blocking layers containing copolymers of methyl vinyl ether and maleic anhydride tend to cause electrical surface potential cycle down. Cycle down affects the final copy by causing loss of electrical contrast between exposed and unexposed areas. In addition, copolymers of methyl vinyl ether and maleic anhydride are sensitive to certain solvents utilized in subsequently applied layers and redissolve and lose integrity as a blocking layer. Hydrolysis of copolymers of methyl vinyl ether and maleic anhydride transforms the anhydride to the acid. The acid formed during storage will attack the metallic conductive layer and result in photoreceptors that will no longer discharge. Moreover, during cycling, corrosion of thin metal ground planes is accelerated and this will also result in photoreceptors that will no longer discharge. Also, when the acid is formed, coating with the material is generally restricted to coating with water and low molecular weight alcohols.

Poly(vinylalcohol) (PVOH) has been evaluated for use as a blocking layer. However, this material forms very viscous aqueous based solutions and is difficult to apply as a coating. For example, very dilute but still viscous poly(vinylalcohol) aqueous solutions requires numerous spray coating passes to build up blocking layer dry thickness to the desired level. Moreover, the aqueous based solvents that are generally used with poly(vinylalcohol) are not conductive to the formation of high quality coatings. In addition, the adhesion of poly(vinylalcohol) to many conductive layer polymers is poor. Also, poly(vinylalcohol) is not available in very high molecular weights (greater than about 400,000 Mw), and even if it were, solutions thereof would be too viscous for one or two pass spray coating of charge blocking layers having optimum thicknesses.

INFORMATION DISCLOSURE STATEMENT

Japanese Patent Publication JP58-152253 published Sep. 9, 1983—An electrophotographic receptor is disclosed containing an undercoat layer of a specified glycidyl (meth)acrylate (co)polymer between a conductive layer and a photosensitive layer. The photosensitive layer may contain a charge generating layer and a charge transport layer. A pendent group contains O, S or $NR_3$ which link a carbon atom to an alkyl or aryl group of the glycidyl methacrylate repeat unit as an essential component of the undercoat layer.

U.S. Pat. No. 4,822,705 issued to Fukagai et al on Apr. 18, 1989—An electrophotographic photoconductor is disclosed comprising electroconductive support, an intermediate layer and a photoconductive layer. The intermediate layer comprises at least one component selected from (a) monohydric aliphatic alcohol, (b) dihydric aliphatic alcohol, (c) polyethylene glycol, (d) polypropylene glycol, (e) polybutylene glycol, (f) polyethylene glycol monoester and/or polyethylene glycol diester, (g) polyethylene monoether, (h) crown ether, (i) a random or block copolymer having a structure of units, a hydroxyethylene group and a hydroxypropylene, and hydroxyl groups at the terminal end thereof and (j) a polymer of a monomer having a certain specified formula and a copolymer of the monomer and a counterpart monomer. The monomer formula depicted contains ether groups as an essential component of the polymers or small molecules of intermediate layers of U.S. Pat. No. 4,822,705. Only nominal molecular weight polymers are used for the intermediate layer polymeric components of U.S. Pat. No. 4,822,705 and the intermediate layer is used on weakly injecting aluminum conductive layers. The member may contain an electroconductive coating layer made of an electroconductive material such Al, Ni, Cr, Zn, stainless steel, carbon, $SnO_2$ and $In_2O_3$ (e.g., see column 3, lines 3 through 8). The intermediate layer may have a thickness of 0.05 to 10 micrometers (e.g., see column 14, lines 10 through 12). The photoconductive layer may comprise a charge generating layer and a charge transport layer (e.g., see column 14, line 14 through column 47, line 7).

U.S. Pat. No. 4,281,055 to Moriguchi et al. on Jul. 28, 1981 (German equivalent appears to be DE 3,006,740)—A photosensitive element for electrophotography is disclosed comprising a photosensitive layer comprising a binder resin and zinc oxide particles dispersed therein, an electroconductive support and an intermediate layer between the photosensitive layer and support, the intermediate layer comprising a water-soluble polymer. The electroconductive support contains electroconductive particles (powder) such as metallic powder and a carbon black powder dispersed therein (e.g., see column 3, lines through 39, particularly lines 27 through 30). The water soluble polymer includes poly(beta-hydroxyethylene acrylate), poly(beta-hydroxyethyl methacrylate) or poly(hydroxypropylmethacrylate) (e.g., see column 3, line 40 through column 4, line 6, particularly column 3, lines 56 through 61). The intermediate layer may have a thickness of from 0.1 to 6 micrometers (e.g., see column 4, lines 14 through 30). The above water soluble intermediate layer polymers of this invention are of nominal molecular weight and moreover are exemplified only on weakly injecting aluminum conductive layers.

U.S. Pat. No. 4,256,822 to Tarumi et al. on Mar. 17, 1981 (German equivalent appears to be DE 2,551,018)—An electrophotography photosensitive plate is disclosed having an interface layer between the substrate and the photosensitive layer, the interface is presented by specific formula for a polymer containing pendant hydroxyl groups from a pendant chain (e.g., see column 2, lines 25 through 61) which also must contain quaternary ammonium salt groups. The molecular weights of the interface layer polymers are stated (column 8; lines 7–8) to be 5,000–200,000.

U.S. Pat. No. 4,500,620 Ohishi on Feb. 19, 1985 (German equivalent appears to be DE 3,325,443)—An electrophotographic lithographic printing material is disclosed comprising a conductive support, an interlayer and a photoconductive layer. The conductive support may comprise a conductive paper laminated with carbon-containing polyethylene on both surfaces. The interlayer may contain a polymer having a certain specified formula. The polymer contains three different repeat units, one of which contains ether linkages, a second repeat unit contains a nitrile group, and a third repeat unit contains a carboxylic acid group (columns 5 and 6; lines 45–51, 59–68) as essential repeat units to obtain the desired interlayer properties.

Japanese Patent Publication JPS 63-318566 published Dec. 27, 1988—An electrophotographic sensitive body is disclosed comprising an interlayer containing a polymer and/or copolymer of a polymer represented by a specific formula and, optionally, another copolymerizable copolymer.

U.S. Pat. No. 2,901,348 to Dessauer et al. on Aug. 25, 1959—A radiation sensitive photoconductive member is disclosed that contains a barrier layer in some electrophotosensitive devices. The barrier layer may be an insulating layer and contain an insulating resin of various types (e.g., see column 9, lines 55 through 75).

U.S. Pat. No. 3,932,179 issued to E. A. Perez-Albuerne on Jan. 13, 1976—A multilayer electrophotographic element is disclosed comprising a conducting layer, a photoconductive layer, and a polymeric interlayer having a surface resistivity greater than about $10^{12}$ ohm/sq between the conducting layer and the photoconductive layer. The interlayer comprises a blend of at least two distinct polymeric phases comprising: (a) a film forming water of alkali-water soluble polymer and (b) an electrically insulating, film forming, hydrophobic polymer. For example, the conducting layer may contain cuprous iodide imbibed in a copolymeric binder of polymethylmethacrylate and polymethacrylic acid. A complex two phase hazy layer, composed of a complex terpolymer (65 wt. percent) of poly(methylacrylate-vinylidene chloride-itaconic acid) and polyvinylmethylether maleic anhydride) (35 wt. percent) is employed as an organic solvent barrier, an adhesive aid, and a hole blocking layer. The film forming water or alkali-water soluble polymer may contain pendant side chains composed of groups such as acidic, hydroxy, alkoxy and ester groups.

U.S. Pat. No. 4,082,551 issued to Steklenski et al on Apr. 4, 1978—A unitary photoconductive element is disclosed having an electrically conducting layer, a photoconductive layer thereon, and a multilayer interlayer composition interposed between the conducting layer and the photoconductive layer. The multilayer interlayer composition comprises a layer containing an acidic polymer material, a layer containing a basic polymer material, and an acid-base reaction product zone formed at the interface of the acidic polymer-containing layer and the basic polymer-containing layer. The basic polymer materials appear to be basic because of the presence of amine groups. Various basic amino methacrylate and acrylate monomers and polymers are disclosed. Thus, for example, the complex barrier bilayer adjacent to a conductive layer may be composed of an acrylic or methacrylic acid copolymer and the top layer composed of a poly 2-vinylpyridine-polymethylmethacrylate copolymer such that a salt interlayer forms at the interface of these acidic and basic polymers. The multilayer interlayer composition provides good adhesion between the conducting and photoconductive layers of the resultant unitary element and can function as an electrical barrier blocking positive charge carriers which might otherwise be injected into the photoconductive layer from the underlying conducting layer.

U.S. Pat. No. 4,584,253 issued to Lin et al on Apr. 22, 1986—An electrophotographic imaging member is disclosed comprising a charge generation layer, a contiguous charge transport layer and a cellulosic hole trapping material located on the same side of the charge transport layer as the charge generation layer. In one example, the cellulosic hole trapping material may be sandwiched between the charge generation layer and an electrically conductive layer.

U.S. Pat. No. 3,113,022 issued to P. Cassiers et al on Dec. 3, 1963—An electrophotographic imaging member for forming latent conductivity images is disclosed. The conductive layer for the member may include gold and various other materials such as a hydrophilic material comprising a hygroscopic and/or antistatic compound and a hydrophilic binding agent. Suitable hygroscopic and/or antistatic compounds include, for example, glycerine, glycol, polyethylene glycols, hydroxypropyl sucrosemonolaurate, etc. Suitable hydrophilic binding agents include gelatin, polyvinyl alcohol, methylcellulose, carboxymethycellulose, cellulosesulphate, cellulose hydrogen phthalate, cellulose-acetatesulphate, hydroxyethyl cellulose, etc. for obtaining a good adhesion of a hydrophilic layer and a hydrophobic polymeric sheet. Also, a coating of a polymeric substance may be used on paper sheets to prevent organic polymeric photoconductive substance and radiation sensitive substance from penetrating within the paper sheet. The coating of a polymeric substance must not prevent the carrying off of electrons from exposed image areas during radiation. Coatings include cellulose diacetate, cellulose triacetate, cellulose acetobutyrate, ethyl cellulose, ethyl cellulose stearate or other cellulose derivatives, polymerisates such as polyacrylic acid esters, polymethacrylic acid esters, polycondensates such as polyethylene glycol esters, diethylene glycol polyesters, etc. An organic polymeric photoconductive substance together with a radiation-sensitive substance is dissolved or dispersed in an organic solvent and coated onto the surface of a suitable support.

U.S. Pat. No. 3,245,833 issued to D. Trevoy on Apr. 12, 1966—Electrically conductive coatings useful as antistatic coatings on photographic films are prepared from cuprous iodide and organic polymers in nitrile solvents (e.g. Example 6). Surface resistivities of $7\text{–}9\times10^3$ ohms/square were obtained after spin coating and drying. Thicknesses do not appear to be disclosed. Coating applications do not appear to be electrophotographic and a polymeric insulative binder is always used with the cuprous iodide wherein the semiconductor metal containing compound () is present in the 15–90 volume percent range.

U.S. Pat. No. 3,428,451 issued to D. Trevoy—Appears to employ some of the conductive coatings described in U.S. Pat. No. 3,245,833 (see above) for use in electrically conductive supports for radiation sensitive recording elements (e.g. an electron microscope where direct electron recording is carried out). Coating applications do not appear to be electrophotographic.

U.S. Pat. No. 3,554,742 issued to Staubll—Conductive coatings (e.g. and polymeric binder) described in U.S. Pat. No. 3,245,833 (see above) appear to be employed in electrophotographic applications. A binder is used with the cuprous iodide as the conductive layer. Barrier layers of block copolycarbonates located between the conductive layer ( and polymeric binder) and a photoconductive layer (e.g. thiapyrilium) improve adhesion to each and charging levels. However, no cyclic electrical data is provided.

U.S. Pat. No. 3,640,708 issued to W. D. Humphries et al—A mixture of and polymeric binder is employed as a conductive layer for electrophotographic devices. Barrier layers, located as described in reference (3), of a polymeric blend of cellulose nitrate and a complex tetrapolymer of methyl acrylate, acrylonitrile, acrylic acid and vinylidene chloride having a thickness of 0.3 to 0.5 micrometer were found to reduce dark decay and improve adhesion. No cyclic electrical data is provided.

U.S. Pat. No. 3,745,005 issued to W. E. Yoerger et al—A mixture of cuprous iodide in a polymeric binder (polyvinylformal) is employed as a conductive layer. A barrier layer (0.3–7 micrometers) consists of a copolymer of vinylacetate and vinylpyrrolidone or vinylacetate and an $\alpha\beta$-unsaturated monoalkenoic acid gives charging levels in the range of 600 to 700 volts in an RH range of 15–80 percent. Claims 3 and 7 refer to conductive layers of carbon dispersed in a binder although this kind of conductive layer is not discussed elsewhere in this patent. No cyclic electrical data is provided.

U.S. Pat. No. 4,485,161 issued to M. Scozzafava et al—Conductive layers containing cuprous iodide in the polymeric binders are disclosed. Barrier layers were solution or bulk coated from polymerizable and crosslinkable monomers having at least one acrylate or methacrylate group and also having an aromatic nucleus or cycloaliphatic nucleus. The barrier layer coating also contained small amounts of a photosensitizer and an amine activator required to promote UV radiation cure of the neat monomer coating. Dry barrier layer coating thicknesses of 2–8 micrometers were obtained. These devices were capable of supporting electric fields of 1.3 to $1.6\times10^6$ volts/cm under corona charging. The $E_{\frac{1}{2}}$ photosensitivity was about 10 ergs/cm$^2$ (Example 3) of 640 nm incident light. The $E_{\frac{1}{3}}$ photosensitivity (Examples 2, 4, 5 and 6) ranged from 6.7–14.9 ergs/cm$^2$ using the same light source. No test of a barrier layer $V_O$ and $V_R$ behavior with repeated xerographic cycling is given. The above data is for only one cycle. These crosslinked barrier layers do reduce the number of white spots produced in the imaged film. The barrier layer also functions as a solvent barrier to toluene and methylene chloride in addition to its electrical function as a hole injection barrier.

U.S. Pat. No. 4,465,751 issued to K. Kawamura et al—The formation of cuprous iodide conductive layers are disclosed wherein the cuprous iodide is imbibed into the polymeric substrate or a subbing adhesive layer on the polymeric substrate when the cuprous iodide-acetonitrile solution is coated without a binder in the same solution. Thus, a binder for the cuprous iodide is generated underneath the by appropriate solvent swelling and/or heat and the result is a -binder conductive layer. Optionally, a -polymer conductive layer wherein cellulose acetate butyrate is used as the polymeric binder is coated directly. The is imbibed and no distinct layer remains.

U.S. Pat. No. 4,410,614 issued to Lelental et al on Oct. 18, 1983—An electrically activatable recording element is disclosed comprising a polymeric electrically active conductive layer. A list of useful copolymers for the polymeric electrically active conductive layer includes many polymethacrylates can be found at column 6, lines 36–62. Synthetic polymers are preferred as vehicles and binding agents in the layers of the electrically activatable recording element. The use of polymers such as poly(vinylpyrrolidone), polystyrene and poly(-vinylalcohol) is disclosed at column 11, lines 14–58.

U.S. Pat. No. 4,262,053 issued to Burwasser on Apr. 14, 1981—An anti-blocking agent for dielectric film for electrostatographic recording is disclosed. The dielectric imaging element may comprise a dielectric film, a film support and conductive layers. The conductive layers include polymers such as quaternized polymers of vinylpyridine with aliphatic esters, polymers of polyacrylic acid salts with metallic coated polyester films, and the like. The conductive layers may be coated with various dielectric resins including styrenated acrylics.

Koji Abe, Mikio-Koide and Eishum Tcuchida, *Macromolecules* 10 (6), 1259–64 (1977)—A polymeric complex is prepared from 4-vinylpyridine (a basic polymer) and polymethacrylic acid (an acidic polymer) to vie a significant amount of the ionized salt structure (FIG. III).

M. M. Coleman and D. J. Skrovanek, Conference Proceeding of 44th ANTEC, 321–2 (1986)—Poly-2-vinylpyridine is shown to interrupt routine hydrogen bonding in an amorphous neutral nylon polymer. The neutral polymer provides an amide hydrogen as a hydrogen bonding site.

U.S. Pat. No. 3,295,967 issued to S. J. Schoenfeld on Jan. 3, 1967—An electrophotographic recording member is disclosed which contains a non-metallic base of high electrical resistivity, a coating on the base for increasing the electrical conductivity, the coating comprising gelatinous hydrated silicic acid and a hygroscopic hydrated inorganic salt, and a photoconductive stratum covering the coating.

U.S. Pat. No. 4,464,450 issued to L. A. Teuscher on Aug. 7, 1984—an electrostatographic imaging member is disclosed having electrically operative layers overlying a siloxane film coated on a metal oxide layer of a metal conductive anode, the siloxane having reactive OH and ammonium groups attached to silicon atoms.

U.K. Patent Application GB 2 009 600 A to Tadaju Fukuda et al, published Apr. 23, 1982—A photoconductive member is disclosed comprising a support, a photoconductive layer constituted of an amorphous material comprising silicon atoms as a matrix and a barrier layer between the support and the photoconductive layer, the barrier layer comprising a first sub-layer constituted of an amorphous material comprising silicon atoms as a matrix and containing an impurity which controls the conductivity and a second sub-layer constituted of an electrically insulating material different from the amorphous material constituting the first sub-layer.

Thus, the characteristics of photosensitive members comprising a support having an electrically conductive charge injecting surface, a blocking layer and at least one photoconductive layer, exhibit deficiencies as electrophotographic imaging members.

SUMMARY OF THE INVENTION

It is an object of the invention to provide an electrophotographic imaging member which overcomes the above-noted disadvantages.

It is an another object of this invention to provide an electrostatographic imaging member having extend life.

It is another object of this invention to provide an electrostatographic imaging member that charges to high voltages useful in xerography.

It is another object of this invention to provide an electrostatographic imaging member which is more dark stable.

It is another object of this invention to provide an electrostatographic imaging member which allows photodischarge with low residual voltage during cycling under most ambient relative humidities.

It is another object of the invention to provide an electrostatographic imaging member that is simpler to fabricate.

It is another object of the invention to provide an electrostatographic imaging member having a blocking layer that is resistant to disturbance or dissolving by components of subsequently applied layers.

These and other objects of the present invention are accomplished by providing an electrophotographic imaging member comprising a supporting substrate having a electrically conductive surface comprising charge injecting material, a charge blocking layer comprising a water insoluble high molecular weight unmodified hydroxy methacrylate having a weight average molecular weight of at least about 400,000 and at least one photoconductive layer, the charge blocking layer having a surface resistivity greater than about $10^{10}$ ohm/sq. This imaging member may be employed in an electrostatographic imaging process.

The supporting substrate layer having an electrically conductive surface may comprise any suitable rigid or flexible member such as a flexible web or sheet. The supporting substrate layer having an electrically conductive surface, may be opaque or substantially transparent, and may comprise numerous suitable materials having the required mechanical properties. For example, it may comprise an underlying insulating support layer coated with a thin flexible electrically conductive layer, or merely a conductive layer having sufficient internal strength to support the electrophotoconductive layer. Thus, the electrically conductive layer may comprise the entire supporting substrate layer or merely be present as a component of the supporting substrate layer, for example, as a thin flexible coating on an underlying flexible support member.

The electrically conductive layer may comprise any suitable electrically conductive, strongly injecting material. Typical strongly injecting materials include metals such as gold, platinum and the like or organic or inorganic nonmetallic material such as carbon black, cuprous iodide, and the like. Preferably, the electrically conductive, strongly injecting material is an organic or inorganic nonmetallic material because greater adhesion between the conductive layer and the charge blocking layer of this invention is achieved. The expression "strongly injecting" as employed herein is defined as an electrically conductive material that is so injecting that a photoreceptor utilizing such electrically conductive material in the ground plane without a charge blocking layer will not charge to a level of at least about 20 volts/micrometer after 200 charge-erase cycles. Charge-erase cycling is described in greater detail in Example I. Typical nonmetallic electrically conductive materials include, for example, carbon black, graphite, cuprous iodide, indium tin oxide alloys, Lewis acid doped polypyrrole and the like. If desired, minor amounts of other electrically conductive materials may be mixed with the strongly injecting electrically conductive metallic or organic or inorganic nonmetallic material. The charge blocking layer polymers of this invention prevent hole injection when strongly injecting species are present in the electrically conductive layer. The electrically conductive layer may be homogeneous or heterogeneous, e.g. strongly injecting nonmetallic electrically conductive particles or metallic electrically conductive particles dispersed in a film forming binder. When hole injecting nonmetallic electrically conductive materials such as carbon black, copper iodide, polypyrrole and other polyaromatic conducting polymers such as polythiophenes, conducting metal oxide such as antimony tin oxide, indium tin oxide, and the like are utilized in a conductive layer, photoreceptors that do not contain a suitable blocking layer can often discharge in the dark thereby rendering the photoreceptor unsuitable for electrophotographic imaging. The ground plane should be continuous and at least monomolecular in thickness. The continuous conductive layer may vary in thickness over substantially wide ranges depending on the desired use of the electrophotoconductive member. Accordingly, the conductive layer can generally range, for example, in thicknesses of from about 50 Angstrom units for some materials to many centimeters. For some ground planes, such as those containing carbon black, a minimum thickness of about 0.5 micrometer is preferred. When a highly flexible photoresponsive imaging device is desired, the thickness of conductive layers may be between about 100 Angstroms to about 2,000 Angstroms. The resistivity of the ground plane should be less than about $10^8$ and more preferably $10^6$ ohms/square for efficient photoreceptor discharge during repeated cycling. If an underlying flexible support layer is employed, it may be of any conventional material including metal, plastics and the like. Typical underlying flexible support layers include insulating or non-conducting materials comprising various resins or mixtures thereof with conductive particles, such as metals, carbon black and the like, known for this purpose including, for example, polyesters, polycarbonates, polyamides, polyurethanes, and the like. The coated or uncoated supporting substrate layer having an electrically conductive surface may be rigid or flexible and may have any number of different configurations such as, for example, a sheet, a cylinder, a scroll, an endless flexible belt, and the like. Preferably, the flexible supporting substrate layer having an electrically conductive surface comprises an endless flexible belt of commercially available polyethylene terephthalate polyester coated with a thin flexible nonmetal coating. Generally, the material selected for the ground plane should not be attacked by solvents ultimately selected for use with the subsequently applied blocking layer. If the blocking layer solvent attacks the ground plane, it may leach out and/or physically dislodge hole injecting components from the ground plane into the blocking layer. In subsequent coating operations, these already migrated hole injection components in the blocking layer may further migrate into the charge generating layer or charge transporting layer from which dark discharge and low charge acceptance can occur. Since hole injection in the charge generating layer or charge transporting layer is cumulative with xerographic cycling, $V_0$ also decreases with cycling ($V_0$ cycle-down).

A charge blocking layer is interposed between the conductive surface and the imaging layer. The imaging layer comprises at least one photoconductive layer. This blocking layer material traps positive charges. The charge blocking layer of this invention comprises a uniform, continuous, coherent blocking layer comprising a water insoluble high molecular weight unmodified hydroxy methacrylate polymer.

The water insoluble high molecular weight hydroxy methacrylate polymer of the blocking layer of this invention is preferably a polymeric reaction product involving one or more hydroxy methacrylate monomers having the following structure:

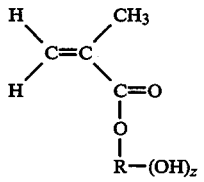

wherein

R is a divalent group selected from the group consisting of a linear or branched saturated aliphatic hydrocarbon group containing 1 to 6 carbon atoms and z is 1 to 6.

Typical divalent R aliphatic groups include methylene, ethylene, propylene, ethylidene, propylidene, isopropylidene, butylene, isobutylene, cyclohexylene, cyclopentylene, cyclobutylene, and the like.

The water insoluble high molecular weight polymeric reaction product of an unmodified hydroxy methacrylate monomer having the above structure may be a homopolymer or copolymer. The copolymer may be a copolymer of 2 or more different hydroxy methacrylate monomers or polymer blocks.

Examples of preferred embodiments of hydroxy methacrylate monomers having the above structure include those having the following structures:

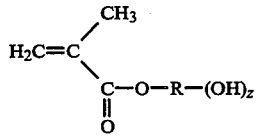

wherein:

R is a lower aliphatic group containing from 1 to 4 carbon atoms and z is 1 to 4.

Optimum results are achieved with monomers having the above structure include those having the following structure:

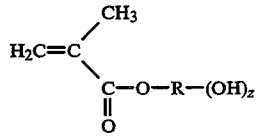

wherein:

R is a lower aliphatic group containing from 2 to 3 carbon atoms and z is 1 or 2.

Polymers can be prepared from these monomers to yield blocking layer compositions having a high degree of purity without electrically deleterious catalyst and/or monomer residues, and at high molecular weights and even very high weight average molecular weights (e.g. ≧1,000,000). Moreover, these polymers are soluble in lower alcohols having from 1 to 4 carbon atoms which enables the coating of these materials on top of organic or inorganic (generally alcohol insoluble) conductive layers without washing away the conductive layer with the alcohol coating solvent. In addition, because these polymers are alcohol soluble and have minimal solubility in more organic coating solvents (such as toluene, tetrahydrofuran, and chlorinated alkanes), subsequently used organic coating compositions overcoated onto the blocking layer do not erode away the blocking layer. If erosion were to occur, the thin or shallow blocking layer areas would cause high dark decay and low charge acceptance.

The water insoluble high molecular weight unmodified hydroxy methacrylate polymer may be a homopolymer, a copolymer, a terpolymer or the like. A preferred homopolymer is represented by the following formula:

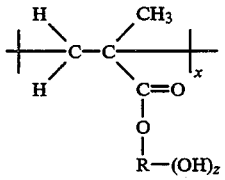

wherein:

x represents sufficient repeat units for a weight average molecular weight between about 400,000 and about 5,000,000, R is a divalent group selected from the group consisting of a linear or branched saturated aliphatic hydrocarbon group containing 1 to 6 carbon atoms, and z is 1 to 6

Typical water insoluble high molecular weight unmodified hydroxy methacrylate polymers include poly(4-hydroxybutyl)methacrylate, poly(3-hydroxypropyl)-methacrylate, poly(2,3-dihydroxypropyl)methacrylate, poly(2,3,4-trihydroxybutyl)methacrylate, poly(2-hydroxyethylmethacrylate), poly(2-hydroxypropylmethacrylate) and the like.

Poly(2-hydroxyethylmethacrylate) [P(HEMA)] is water insoluble and particularly insoluble in subsequently employed organic coating solvent. P(HPMA) exhibits some solubility in tetrahydrofuran when stirred in that solvent at room temperature for a prolonged time period (overnight). If the solvent evaporation is rapid, such as in a coating process normally employed to manufacture photoreceptors, then tetrahydrofuran solubility of the blocking layer polymer is an unlikely problem. Further, these polymers, particularly P(HEMA), attract about one weight percent water and retain much of the trapped water in a dense hydrogen bonding network even at low RH. The trapped water assists in the transport of photodischarged electrons through the blocking layer to the conductive layer and also assists in preventing electron trapping and $V_R$ cycle-up. The higher the hydroxy methacrylate blocking layer polymer molecular weight, the higher the intermolecular H-bonding density and the retentive trapping of water at low RH, and the solvent barrier (to prevent solvent wash away of the blocking layer) properties of these polymers.

The presence of the ester group along with a hydroxyl group in each polymeric repeat unit not only maximizes intermolecular H-bonding in the form of OH—OH H-bonding and carbonyl (of the ester) —OH-bonding, but also allows for some intramolecular (5, 6 and 7 membered rings) H-bonding to maintain overall H-bonding density particularly in those blocking layer areas where intermolecular H-bonding is below the average, presumably because of conformationally unfavorable chain configurations. Thus, this intramolecular mode of H-bonding along with trapped water can maintain high H-bonding density which assists electron transport and completes photodischarge (low $V_R$). All of these properties contribute to enhanced photoreceptor electrical performance.

The water insoluble high molecular weight unmodified hydroxy methacrylate polymer may be crosslinked and uncrosslinked. If crosslinked, crosslinking may be effected by any suitable difunctional (or higher polyfunctionality) compound (usually a small molecule) that can react with hydroxyl groups at temperatures of less than about 135° C. (where the substrate is polyethylene terephthalate) to crosslink the hydroxy ester polymers through the hydroxyl groups. Higher temperatures may be utilized if the substrate is not adversely softened at the reaction temperatures. Typical polyfunction compounds include diisocyanates such as toulenediisocyanate, methylenediisocyanate, isophoronediisocyanate, hexamethylenediisocyanate, and the like, blocked diisocyanates, polyfunctional aziridines such as XAMA-2 and the like, and polyfunctional epoxides such as 1,3-butadienediepoxide, 1,4-butanediol diglycidyl ether, ethylene glycol diglycidyl ether, neopentyl glycol diglycidyl ether, bisphenol A diglycidyl ether, 1,4-divinylbenzene diepoxide, difunctional aldehydes and the like. The difunctional aldehyde may have the following structure:

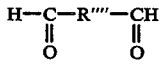

wherein R'''' is a divalent hydrocarbon or heteroaromatic unit or covalent bond. Typical R'''' groups include methylene, ethylene, propylene, phenylene, biphenylene, pyridylene, and the like. Typical difunctional aldehydes include, for example, glutaraldehyde, glyoxal, 2,6-pyridinedicarboxaldehydes, terephthaladehyde, and the like.

The initial reaction product from the chemical reaction of two hydroxyl groups (one from each chain) with both ends of a difunctional aldehyde is illustrated below:

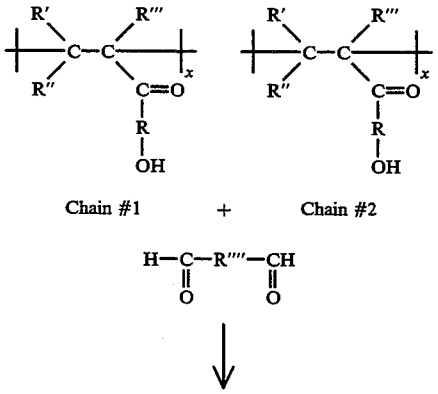

to form hemiacetal linkages between two chains shown below:

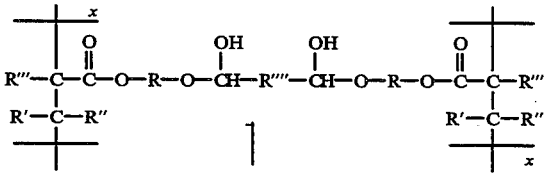

The two OH groups in the hemiacetal linkages can further combine with two more OH groups in the polymer repeat units (or can remain as is, which is already a crosslink) to give acetal crosslinks with the elimination of water as illustrated below:

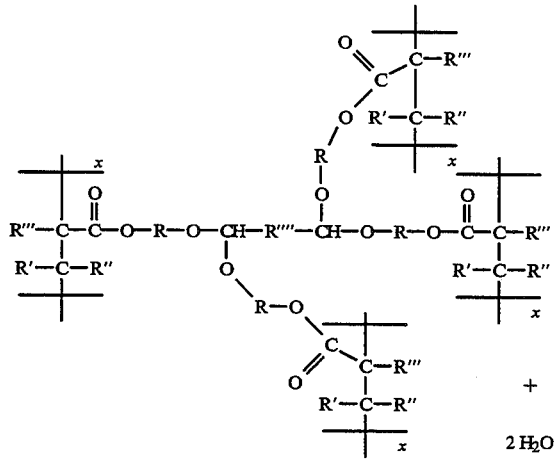

The relative extent of hemiacetal and acetal crosslinking in dialdehyde crosslinked hydroxy ester polymer blocking layers is unknown. The higher the oven temperature during drying (solvent removal) of the blocking layer (up to a maximum of about 135° C.) and the longer the temperature is maintained at an elevated level (up to a practical maximum of about one hour) the more acetal linkages will form from the hemi-acetal linkages and other polymer repeat units and the higher will be the crosslink density. The monofunctional aldehydes (through acetal crosslinks only) can also be used to crosslink these hydroxy methacrylate polymers but the crosslinking efficiency is less than that for the difunctional aldehyde because fewer crosslinks are formed per mole of monofunctional aldehyde versus difunctional aldehyde, all other factors being equal. Each time an acetal crosslink is formed, two hydroxyl groups in the hydroxy methacrylate are consumed. Thus, a high crosslink density can consume many hydroxyl groups which in turn will significantly reduce the H-bonding density and electron transport capability of these blocking layers. Thus, a minor amount of crosslinking with monofunctional aldehydes (through acetal crosslinks only) is acceptable, but too much could lead to $V_R$ cycle-up (electron trapping). Crosslinking by hemiacetal crosslinks does not change the number of hydroxyl groups and is, therefore preferred. However, any other suitable technique may be utilized to crosslink hydroxy methacrylate polymers through the hydroxyl groups. Generally, if catalysts are employed with the polyfunctional compounds, care should be taken to wash out the catalyst and avoid catalytic residues in the final blocking layer which might adversely affect electrical properties. Similarly, other permanent nonvolatile residues which might interfere with the desired final electrical properties of the blocking layer should be avoided. This also ensures that there is no undesirable residue that could migrate out of the blocking layer or which could function as an electron trap in the blocking layer. The expression "unmodified" as employed herein is defined as an uncrosslinked hydroxy methacrylate polymer comprising about the same number of hydroxy methacrylate repeat units in the hydroxy methacrylate monomer(s) that underwent conversion to polymer, or a hydroxy methacrylate cross-linked polymer having a decreased number of hydroxyl groups in the hydroxy methacrylate repeat units versus the hydroxy methacrylate monomer(s) that underwent conversion to the polymer wherein the decrease is based exclusively on the hydroxyl groups consumed in the cross-linking process. Thus, if a polymer is modified, a chemical grouping is attached to the unmodified polymer as a pendent group that is not capable of cross-linking with itself or other repeat units in the modified polymer.

Satisfactory results may be achieved with water insoluble high molecular weight unmodified hydroxy methacrylate polymers having a weight average molecular weight of at least about 400,000, the upper limit being limited by the viscosity necessary for processing (generally about 5,000,000). Preferably, the weight average molecular weight is between about 600,000 and about 5,000,000. Optimum blocking layer performance is obtained when the weight average molecular weight is between about 950,000 and about 5,000,000. When the weight average molecular weight is less than about 400,000, the hydroxy methacrylate blocking layer becomes less effective as a barrier layer thereby allowing unwanted migration of electroconductive layer species into the blocking layer and subsequently coated layers, and the hydroxy methacrylate blocking layer also becomes less effective as an electron transporting material because of a lower level of water entrapment therein especially at low RH. These low molecular weight deficiencies result in inferior cyclic electrical properties in the form of $V_O$ cycle down and $V_r$ cycle-up. $T_g$ or glass transition temperature has no known effect on the ability of a hole blocking layer of this invention to function effectively.

Optimum results are achieved with the water insoluble high molecular weight unmodified hydroxy methacrylate polymer poly(2-hydroxyethylmethacrylate) [P(HEMA)] which is represented by the following formula:

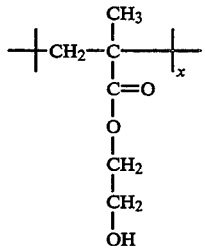

wherein x represents sufficient repeat units for a weight average molecular weight between about 950,000 and about 5,000,000.

Another preferred vinyl hydroxy ester polymer is poly(2-hydroxypropylmethacrylate) [P(HPMA)] which is represented by the following formula:

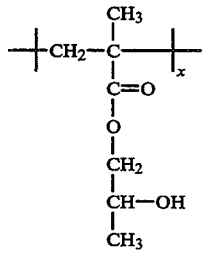

wherein x represents sufficient repeat units for a molecular weight between about 600,000 and about 5,000,000.

The water insoluble high molecular weight unmodified hydroxy methacrylate polymers of this invention may be blended with other miscible water insoluble high molecular weight unmodified hydroxy methacrylate compatible polymers to provide a blended blocking layer of this invention. Typical miscible water insoluble high molecular weight unmodified hydroxy methacrylate polymers include poly(2hydroxyethyl methacrylate), poly(2-hydroxypropy methacrylate), poly(4-hydroxybutyl)methacrylate, poly(3-hydroxypropyl)-methacrylate, poly(2,3-dihydroxypropyl)methacrylate, poly(2,3,4-trihydroxybutyl)methacrylate and the like. Miscibility is defined as a non-hazy coating (after drying) of equal amounts of the two copolymers cast from common solution of the two copolymers in one solvent. These are all random (not blocked) copolymers, but block copolymers prepared by group transfer polymerization (GTP) may also be used when prepared at the high molecular weights previously defined for satisfactory, preferred and optimum blocking layer compositions. These polymers are capable of forming dense OH—OH and ester group-OH H-bonding sites which are sufficiently numerous to prevent large domain phase separation. The blended water insoluble high molecular weight unmodified hydroxy methacrylate polymers may be blends of homopolymers, copolymers or terpolymers or blends of some or all of the above or may have as many different repeat units as desired providing that all the repeat units are derived from unmodified hydroxy methacrylate monomers capable of being polymerized to water insoluble high molecular weight polymers. The mole percent of each hydroxy methacrylate repeat unit in the copolymer should be chosen so as to provide the maximum solvent barrier properties to solvents used to coat subsequent photoreceptor layers, thereby minimizing deleterious interlayer mixing which leads to unsatisfactory cyclic electrical properties.

The specific composition selected for the ground plane will influence the thickness of the blocking layer selected. Generally, nonmetallic or oxidizable charge injection ground plane materials require a thicker blocking layer. For example, a photoreceptor utilizing a charge injecting ground plane layer containing copper iodide without an overlying blocking layer merely charges to about 3 volts/micrometer. When a sufficiently thick blocking layer of this invention is applied over the ground plane layer containing copper iodide, the photoreceptor will charge to levels at least about 20 volts/micrometer. Charge levels of at least about 30 volts/micrometer are preferred with optimum results being achieved at levels of at least about 40 volts/micrometer. At levels below about 20 volts/micrometer, contrast potential decreases and lighter images cannot be developed with two-component dry xerographic developers.

The blocking layer mixture is applied to the conductive surface of the supporting substrate. The blocking layer mixture of this invention may be applied by any suitable conventional technique. Typical application techniques include spraying, dip coating, roll coating, wire wound rod coating, and the like. Coating compositions are usually applied with a solvent. Typical solvents include methanol, 1-methoxy-2-hydroxypropane, tertiary butyl alcohol, and mixtures of these solvents with other alcohol solvents and tetrahydrofuran and the like. Choice of solvents depends upon the nature of the conductive layer upon which the barrier layer is applied and also on the properties of the polymers constituting the blocking layer. Appropriate solvents can, in general, be selected based on the known properties of the individual polymers, as is well known in the art. Mixtures of solvents may also be used, if desired. The proportion of solvent to be utilized varies with the type of coating technique to be employed, e.g., dip coating, spray coating, wire wound bar coating, roll coating, and the like so that the viscosity and volatility of the coating mixture is adjusted to the type of coating technique utilized. Generally, the amount of solvent ranges from between about 99.8 percent by weight to about 90 percent by weight, based on the total weight of the coating composition. Typical combinations of specific solvents and polymers include, for example, poly(2-hydroxyethylmethacrylate) and 1-methoxy-2-hydroxypropane (Dowanol PM, available from Dow Chemical Co.) or tertiary butyl alcohol. Basic alcohols such as dimethylaminoethanol and acidic alcohols such as 2,2,2-trifluoroethanol also dissolve poly(2-hydroxyethylmethacrylate) significantly at room temperature but solvent neutrality is usually desirable to avoid interference with the ground plane or other layers affecting photoreceptor electrical performance. High boiling dipolar aprotic solvents such as dimethylformamide, dimethylacetamide and N-methylpyrrolidone (DMF, DMAC and NMP respectively) also dissolve poly(2-hydroxyethylmethacrylate) extensively but are less desirable because total solvent removal from the coatings is more difficult to achieve due to the high boiling points of these solvents. Thus, there are a limited number of solvents suitable for coating water insoluble high molecular weight unmodified hydroxy methacrylate polymers. The limited solubility of water insoluble high molecular weight unmodified hydroxy methacrylate polymers in common organic solvents is desirable because the deposition of subsequent device layers, such as the generator layer, from solutions using common solvents such as toluene and tetrahydrofuran, and the transport layer, using common solvents such as methylene chloride, does not cause extensive solvent induced migration of these hydroxy methacrylate polymers from the blocking layer into the layers overlying the blocking layer.

The water insoluble high molecular weight unmodified hydroxy methacrylate polymers and copolymers of this invention have chemical structures containing hydroxyl groups which assist in retaining $H_2O$ through hydrogen bonding. The combination of the presence of hydroxyl groups and a small amount of water are believed to assist in enabling hole blocking layers to function effectively during charging and photo discharging negatively charged photoreceptors. Moreover, the presence of the hydroxyl groups also provides the insolubility of the blocking layer towards the coating compositions deposited on top of the blocking layer such as the charge generating layer (applied with typical organic solvents such as toluene and tetrahydrofuran) and the charge transport layer (applied with typical organic solvents such as chlorinated alkane solvents, e.g. methylene chloride, 1,2-dichloroethane and 1,1,2-trichloroethane). If the blocking layer polymer is soluble in any of the organic solvents used in coating subsequent layers, the thickness uniformity and integrity thereof could be adversely affected because the organic solvents may wash the blocking layer material into the charge generating layer and/or charge transport layer. Thinner blocking layer or areas devoid of blocking layer material can result in very poor or even negligible device charge acceptance and high dark charge decay rate. The organic (non-hydroxyl containing) polymers described in U.S. Pat. No. 4,410,614 would be too soluble in the above-mentioned organic solvents and, therefore, would not be suitable as blocking layers where the above-mentioned organic solvents are utilized with subsequently applied layers. Thus, for example, only a very limited number of organic solvents such as alcohols, glycol ethers and dipolar aprotic solvents can be utilized for the hydroxyl group containing polymeric blocking layer materials of this invention.

The molecular weight of the water insoluble high molecular weight unmodified hydroxy methacrylate polymer of this invention, as indicated by a dilute solution viscosity measurement, such as inherent viscosity, intrinsic viscosity, or reduced viscosity, is believed to be important in blocking layer applications because higher molecular weight polymers (all other things being equal) swell much more slowly than lower molecular weight polymers. Also, the use of higher molecular weight polymers in blocking layer applications allows the hydroxyl polymers to better encapsulate small molecules, such as water. Thus, longer chains of hydroxyl polymers can better encircle small water molecules and can better hydrogen bond these water molecules by providing more H-bonding sites per polymer chain when the polymer has a very high molecular weight. Also high molecular weight polymer chains can entangle (similar to spaghetti) with a larger number of contact sites than can low molecular weight polymer chains because the higher molecular weight polymer chains encompass or fill a larger volume of space. A contact site with the hydroxy methacrylate repeat unit of this invention means a hydrogen bonding site at another hydroxy methacrylate repeat unit in the same polymer chain or with a neighbor chain. Therefore, longer (or higher MW) polymer chains will have more contact or entanglement sites with more neighbor chains creating a denser and tighter H-bonding network to encapsulate small H-bonding molecules such as water. Therefore, even at low relative humidity (RH) conditions, very little water will migrate out of the water insoluble high molecular weight unmodified hydroxy methacrylate polymer blocking layer thereby allowing the blocking layer to continue to function effectively even at low RH. Thus, devices containing the higher molecular weight blocking layers of this invention show only a minimal increase in $V_R$ cycle-up at low RH. Water soluble unmodified hydroxy methacrylate polymers tend to gain too much water under high humidity conditions and give up too much water under low humidity conditions thereby contributing to large, uncontrolled swings in electrical conductivity during changes in atmospheric humidity. This undesirable characteristic requires installation of highly sophisticated and complex equipment to compensate for these great conductivity changes in high speed copiers, duplicators and printers that require narrow, precise operating tolerances. The expression "water insoluble" as employed herein is defined as a polymer which does not completely dissolve at room temperature in water as the sole solvent at any practical coating concentration using any of the common coating procedures. Moreover, during fabrication of the charge generating layer and/or charge transport layer, solvent contact with the surface of the blocking layer will cause less physical disruption of the top of the blocking layer when a high molecular weight polymer is utilized. This further preserves the thickness uniformity of the hole blocking layer and its ability to function effectively. Poly(2-hydroxyethylmethacylate) available from Scientific Polymer Products, has a molecular weight of about 1.0 to $1.4\times10^6$ based on dilute solution measurements wherein the reduced viscosity is 1.8 to 2.0 g/dl. Compared to the much lower viscosities, and thus molecular weights, of the polymers cited in U.S. Pat. Nos. 4,410,614 and 4,256,822, and compared to the indicated solution polymerization procedures in U.S. Pat. Nos. 4,822,705 and 4,500,620 which yield polymers having weight average molecular weights less than 400,000 and probably considerably less than 400,000, a high molecular weight poly(2-hydroxylethylmethacylate) blocking layer of this invention is believed to have an intrinsic blocking layer advantage (because of a lower swelling rate) over the organic polymethacrylates described in U.S. Pat. No. 4,410,614.

After the blocking layer coating is applied, the deposited coating is heated to drive out the solvent and form a solid continuous film. Generally, a drying temperature between about 110° C. and about 135° C. is preferred to minimize any residual solvent, and to minimize any distortion to organic film substrates such as biaxially oriented polyethylene terephthalate. The temperature selected depends to some extent on the specific electrically conductive layer utilized and is limited by the temperature sensitivity of the substrate. The drying temperature may be maintained by any suitable technique such as ovens, forced air ovens, radiant heat lamps, and the like. The drying time depends upon the temperatures used. Thus, less time is required when higher temperatures are employed. Generally, increasing the drying time increases the amount of solvent removed. One may readily determine whether sufficient drying has occurred by chromatographic or gravimetric analysis. A typical treatment involves application of the coating with a half mil Bird coating bar followed by heating of the deposited coating at 130° C. for about 10 to 30 minutes. Generally, satisfactory results may be achieved with a dried blocking layer coating having a thickness between about 0.05 micrometer and about 8 micrometers on some conductive layers. When the thickness of the layer exceeds about 8 micrometers, the electrophotographic imaging member may show poor discharge characteristics and residual voltage build-up after erase during cycling. A thickness of less than about 0.02 micrometer tends generally to result in pin holes as well as high dark decay and low charge acceptance due to non-uniformity of the thickness of different areas of the blocking layer. The preferred thickness range is between about 0.3 micrometer and about 1.5 micrometers with optimum blocking results being achieved with a thickness of between about 0.8 micrometer and about 1 micrometer on most conductive surfaces. The surface resistivity of the dry blocking layer of the present invention should be greater than about $10^{10}$ ohms/sq as measured at room temperature (25° C.) and one atmosphere pressure under 40 percent relative humidity conditions. This minimum electrical resistivity prevents the blocking layer from becoming too conductive.

Some of the blocking layer materials of this invention can form a layer which also functions as an adhesive layer. However, if desired, an optional thin adhesive layer may be utilized between the relatively thick blocking layer and the charge generation layer. Any suitable adhesive material may be applied to the blocking layer. Typical adhesive materials include polyesters (e.g. 49000, available from E.I. duPont de Nemours & Co. and PE100 and PE200, available from Goodyear Tire & Rubber Co.) polyvinylbutyral, polyvinyl formal, polyvinylpyrolidone, polyamide, polyurethane, polyvinyl acetate, polyvinyl chloride, polyimide, polycarbonate, copolymers thereof, blends thereof and the like. Generally, satisfactory results may be achieved with adhesive layers having a thickness of between about 0.005 micrometer to about 0.2 micrometer. A preferred thickness is from about 0.02 micrometer to about 0.15 micrometer. Optimum results are achieved with a thickness of about 0.03 micrometer (300 angstroms) to about 0.12 micrometer from materials such as polyvinyl pyridine. When the thickness of the adhesive layer exceeds about 0.2 micrometer, residual voltage begins to cycle up excessively. Adhesive layers are especially useful for enhancing adhesion to charge generation layers containing materials, such as polyvinyl carbazole, which adhere poorly to water insoluble high molecular weight unmodified hydroxy methacrylate blocking layer polymers. Typical adhesive layer materials are those producing strong hydrogen bonds with the hydroxy methacrylate polymers such as poly(4-vinylpyridine), poly(2-vinylpyridine), and the like. Adhesive layers containing poly(4-vinylpyridine) form a hydrogen bonded polymeric complex with the hydroxy methacrylate blocking layer polymers which are believed to be unique adhesive compositions having solubility properties which allow the adhesive layer to also function as a solvent barrier layer.

In U.S. Pat. No. 4,082,551, an acidic polymer and a basic polymer are sequentially coated onto a substrate instead of a neutral polymer and a basic polymer as accomplished in one embodiment of this invention. This means that a polymeric salt complex forms in the device of U.S. Pat. No. 4,082,551 whereas a hydrogen bonded polymeric complex is formed in one embodiment of this invention. The polymeric salt complex is a different composition of matter than the hydrogen bonded polymeric complex. More specifically, in U.S. Pat. No. 4,082,551, a multilayer interlayer composition is disclosed comprising a lower layer (adjacent to the conductive layer) containing an acidic polymeric material (e.g. 0.4 micrometer layer of polyacrylic acid or methacrylic acid copolymer) and an upper layer (adjacent to the photogenerator layer) containing a basic polymeric material (e.g. 0.2 micrometer thick layer of a poly (2-vinylpyridine)-polymethylmethacrylate copolymer). At the polymeric interface of this multilayer-interlayer composition, an acid-base reaction product zone otherwise called a salt interlayer is generated. The total thickness of this complex multilayer interlayer composition can be between 0.2 micrometer to 1.0 micrometer and its function is to provide good adhesion between the conductive and photoconductive layers and to act as an electrical barrier blocking positive charge carrier injection (hole injection) from the conductive layer to the photoconductive layer. However, a major difference between the composite blocking/adhesive layer composition embodiment of the instant invention and that described in U.S. Pat. No. 4,082,551 is that the instant invention embodiment utilizes, for example, a very thin (e.g. 0.06 micrometer) basic poly (4-vinylpyridine) adhesive enhancement component on top of a thicker (e.g. 0.2 to 1.5 micrometer) neutral water insoluble high molecular weight unmodified hydroxy methacrylate polymer hole blocking component. The presence of poly (4-vinylpyridine) component is not required to obtain high charge levels, (which is the same as preventing hole injection from the conductive layer to the photoconductive layer) but as a hydrogen bonded polymeric complex with the top of the hydroxy methacrylate polymer hole blocking component. The poly (4-vinylpyridine) hydroxy methacrylate polymer interface also performs the functions of any interface material beneath the photogenerator layer. The hydroxy methacrylate hole blocking component polymer alone performs these functions but the poly (4-vinylpyridine) enhances adhesion to generator layers. The poly (4-vinylpyridine) hydroxy methacrylate polymer adhesive interface also functions as a solvent barrier layer towards the solvents used to coat the layers above, and also readily accepts and transports photodischarged electrons when these photodischarged electrons arrive at the poly (4-vinylpyridine) hydroxy methacrylate polymer interface from the photogenerator layer. Although the projected thickness of the poly (4-vinylpyridine) layer is based on dried control coatings of known coating solution concentrations on glass plates, the actual thickness may vary depending on the depth of penetration of the poly (4-vinylpyridine) into the thick hydroxy methacrylate polymer layer beneath. In a typical example, a draw bar coated (0.5 mil bar gap) poly (4-vinylpyridine) adhesive layer composition can consist of a 0.6 weight percent solution of 0.12 g poly (4-vinylpyridine) (Reillene 4200, available from Reilly Tar and Chemical Co.) in 17.89 g isobutanol and 1.99 g isopropanol. The drawbar coating process can be carried out on a previously dried hydroxy methacrylate polymer blocking layer and the resulting poly (4-vinylpyridine) layer can similarly be dried for one hour under ambient conditions and then for one hour at 100° C. in an air convection oven. The depth of penetration of the poly (4-vinylpyridine) polymer into the hydroxy methacrylate polymer layer is largely a function of the solubility of the hydroxy methacrylate polymer in the solvent (e.g. isobutanol-isopropanol mixture) used to apply the poly(4-vinylpyridine). Hydroxy methacrylate polymers, such as poly(2-hydroxypropylmethacrylate), which has significant solubility in the above solvent mixture would be expected to imbibe the poly(4-vinylpyridine) to a larger penetration depth versus poly(2-hydroxyethylmethacrylate) which has almost no solubility in the alcoholic solvent mixture. Consequently, different thicknesses of the poly(4-vinylpyridine) hydroxy methacrylate polymer interface will result. It is expected that a gradient distribution of poly(4-vinylpyridine) in the poly(4-vinylpyridine) hydroxy methacrylate polymer interface layer occurs with the highest concentration of poly(4-vinylpyridine) chains near the top surface of the interlayer and the lowest concentration of poly(4-vinylpyridine) chains at the bottom of the interlayer where pure hydroxy methacrylate polymer resides. After solvent evaporation from the poly(4-vinylpyridine) coating, hydrogen bonding between the poly(4-vinylpyridine) and the mixed and adjacent hydroxy methacrylate polymer occurs thus anchoring the poly(4-vinylpyridine) chains into the interface layer composition. If the poly(4-vinylpyridine) is coated too thickly, poly(4-vinylpyridine) can migrate into the generator layer during subsequent coating steps and cause $V_R$ cycle-up. Thus, too thick a coating of poly(4-vinylpyridine) can result in a surplus of poly(4-vinylpyridine) chains adjacent to each other and not adjacent to the hydroxy methacrylate polymer chains where hydrogen bonding anchoring occurs. These unanchored poly(4-vinylpyridine) chains can migrate upward if solubilized by the solvents used to coat the subsequent layers above. poly(4-vinylpyridine) hydrogen bonded to hydroxy methacrylate polymer comprises an insoluble solvent barrier layer. Thus, an optimum coating concentration thickness of about 0.6 weight percent, as previously described, provides an extrapolated poly(4-vinylpyridine) coating thickness of 0.06 micrometer (not the poly(4-vinylpyridine) hydroxy methacrylate polymer interface thickness) which results in a totally hydrogen bonded poly(4-vinylpyridine) and an excellent adhesive solvent barrier interface layer. Such a poly(4-vinylpyridine) hydroxy methacrylate polymer interface layer of optimum poly(4-vinylpyridine) concentration in devices comprising a charge generation layer and a charge transport layer show little or no increase in $V_R$ during charge-erase cycles.

In U.S. Pat. No. 4,082,551, the acid-base reaction product formation described (Column 8, lines 32–53) involves taking equal weights of an acidic and basic polymer, individually dissolving them in methanol, and combining the two resulting solutions to form an insoluble reaction product. The insoluble reaction product is said to be indicative of the acid-base product zone formed at the interface of the acidic polymer layer and basic polymer layer present in the multilayer interlayer compositions. Furthermore in Column 7, lines 32–43, the patent states that "what is critical to the present invention is that the acid polymer layer contain polymer(s) which has sufficient acidity and that the basic polymer layer contain polymer(s) which has sufficient basicity such that an acid-base reaction product between these two layers can be formed at the interface thereof".

The above insoluble reaction product formation test was repeated using poly(2-hydroxyethylmethacrylate) (available from Polysciences) and poly(4-vinylpyridine) (Reillene 4200, available from Reilly Tar and Chemical Co.) in the same methanol solvent. However, in the product of the instant invention, the test is indicative of not an acid-base reaction product as described above in U.S. Pat. No. 4,082,551, but of a neutral hydrogen donor polymer poly(2-hydroxyethylmethacrylate) and a basic nitrogen polymer poly(4-vinylpyridine) hydrogen bonded polymeric complex, that is, the hydroxyl hydrogen is only partially transferred as a proton to the pyridine nitrogen or is shared between them to form the hydrogen bonded polymeric complex. Thus, the product of the instant invention is free of an acid-base reaction product as described above in U.S. Pat. No. 4,082,551.

In U.S. Pat. No. 3,932,179 a multilayer electrophotographic element is disclosed comprising a conducting layer, a photoconductive layer, and a polymeric interlayer having a surface resistivity greater than about $10^{12}$ ohm/sq between the conducting layer and the photoconductive layer. The interlayer comprises a blend of at least two distinct polymeric phases comprising: (a) a film forming water or alkali-water soluble polymer and (b) an electrically insulating, film forming, hydrophobic polymer. For example, the conducting layer may contain cuprous iodide imbibed in a copolymeric binder of polymethylmethacrylate and polymethacrylic acid. A complex two phase hazy layer, composed of a complex terpolymer (65 wt. percent) of poly(methylacrylate-vinylidene chloride-itaconic acid) and poly(vinylmethylether maleic anhydride) (35 wt. percent) is employed as an organic solvent barrier, an adhesive aid, and a hole blocking layer. In column 4, line 47, type 3 polymers are described as polymers, including homopolymers and copolymers, comprising a backbone chain of repeating hydrocarbon units and acidic groups containing up to 10 carbon atoms as pendant side chains chemically bonded to the backbone chain. Useful acidic groups may be selected from the group consisting of sulfonic acids, carboxylic acids and carboxylic anhydrides. In column 4, line 54, it is indicated that pendant side chains composed of other groups, for example, such as hydroxy, alkoxy and ester groups having up to ten carbon atoms may also be present in the aforementioned type 3 polymers. In column 4, line 57, it is clear that typically, the type 3 polymers have at least 3 or more repeating units in the backbone chain. The list of these show no hydroxy groups in the polymer. In the type 3 polymers, the acidic group appears to be essential to the functioning of these materials as blocking layers. The presence of hydroxy groups in type 3 polymers is an incidental occurrence, not essential to the composition required to give an effective type 3 blocking layer. In addition, type 3 polymers have 3 or more repeat units in the backbone chain wherein an acid group must be contained in at least one of these repeat units. If an acid group is present (and it must be in all of the preferred type 3 copolymers (see bottom of column 4 and top of column 5 of U.S. Pat. No. 3,932,179) the carboxylic acid group provides the water solubility or alkali solubility (pH 7 to 12) that the type 3 polymers must possess. The blocking layer polymers of the instant invention are not water soluble and nor do they need to be combined with a hydrophobic polymer. The preferred blocking layer of the instant invention contains only hydroxy methacrylate repeat units so it contains a very high concentration of hydroxyl groups (not incidental) and no acid groups for water solubility since water solubility is to be avoided. The blocking layer of the instant invention with the neutral hydroxyl blocking layer polymers achieves very dense H-bonding with numerous hydroxyl groups that the 2 component, blocking layers in U.S. Pat. No. 3,932,179 cannot achieve because the amount of H-bonding in U.S. Pat. No. 3,932,179 blocking layer polymers are many fewer (COOH—HOOC) per chain than in a blocking layer polymer such as P(HEMA). The hydroxyl polymers [e.g. P(HEMA)] have an O—H group in every repeat unit whereas the terpolymer in U.S. Pat. No. 3,932,179 has many fewer COOH groups because the itaconic acid (or any other acid containing repeat unit in these terpolymers) is only 1 of 3 repeat units in the backbone chain. After dilution with the second polymer component, the COOH group content may further decrease and, therefore, so will the acid—acid H-bonding density which was low initially.

Generally, as described above and hereinafter, the electrophotoconductive imaging member of this invention comprises a supporting substrate layer having an electrically conductive surface, a water insoluble high molecular weight unmodified hydroxy methacrylate polymer containing blocking layer and a photoconductive imaging layer. The photoconductive layer may comprise any suitable photoconductive material well known in the art. Thus, the photoconductive layer may comprise, for example, a single layer of a homogeneous photoconductive material or photoconductive particles dispersed in a binder, or multiple layers such as a charge generating overcoated with a charge transport layer. The photoconductive layer may contain homogeneous, heterogeneous, inorganic or organic compositions. One example of an electrophotographic imaging layer containing a heterogeneous composition is described in U.S. Pat. No. 3,121,006 wherein finely divided particles of a photoconductive inorganic compound are dispersed in an electrically insulating organic resin binder. The entire disclosure of this patent is incorporated herein by reference. Other well known electrophotographic imaging layers include amorphous selenium, halogen doped amorphous selenium, amorphous selenium alloys including selenium arsenic, selenium tellurium, selenium arsenic antimony, and halogen doped selenium alloys, cadmium sulfide and the like. Generally, these inorganic photoconductive materials are deposited as a relatively homogeneous layer.

This invention is particularly desirable for electrophotographic imaging layers which comprise two electrically operative layers, a charge generating layer and a charge transport layer.

Any suitable charge generating or photogenerating material may be employed as one of the two electrically operative layers in the multilayer photoconductor embodiment of this invention. Typical charge generating materials include metal free phthalocyanine described in U.S. Pat. No. 3,357,989, metal phthalocyanines such as copper phthalocyanine, vanadyl phthalocyanine, selenium containing materials such as trigonal selenium, bisazo compounds, quinacridones, substituted 2,4-diaminotriazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. Nos. 4,265,990, 4,233,384, 4,471,041, 4,489,143, 4,507,480, 4,306,008, 4,299,897, 4,232,102, 4,233,383, 4,415,639 and 4,439,507. The disclosures of these patents are incorporated herein by reference in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. Nos. 3,121,006 and 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, the photoconductive material need only to comprise about 1 percent or less by volume of the binder layer with no limitation on the maximum amount of photoconductor in the binder layer. Generally for charge generator layers containing an electrically active matrix or binder such as polyvinyl carbazole or phenoxy resin [poly(hydroxyether)], from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder. The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photogenerated holes and electrons from the charge generation layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. does not discharge at a rate sufficient to prevent the formation and retention of an electrostatic latent image thereon.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

An especially preferred transport layer employed in one of the two electrically operative layers in the multilayer photoconductor embodiment of this invention comprises from about 25 to about 75 percent by weight of at least one charge transporting aromatic amine compound, and about 75 to about 25 percent by weight of a polymeric film forming resin in which the aromatic amine is soluble.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4′-4″-bis(diethylamino)-2′,2″-dimethyltriphenyl-methane, N,N′-bis(alkylphenyl)-[1,1′-biphenyl]-4,4′-diamine wherein the alkyl is, for example, methyl, ethyl, propyl, n-butyl, etc., N,N′-diphenyl-N,N′-bis(chlorophenyl)-[1,1′-biphenyl]4,4′-diamine, N,N′-diphenyl-N,N′-bis(3″-methylphenyl)-(1,1′-biphenyl)-4,4′-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

The preferred electrically inactive resin materials are polycarbonate resins having a molecular weight from about 20,000 to about 100,000, more preferably from about 50,000 to about 100,000. The materials most preferred as the electrically inactive resin material is poly(4,4′-dipropylidene-diphenylene carbonate) with a molecular weight of from about 35,000 to about 40,000, available as Lexan 145 from General Electric Company; poly(4,4′-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G., a polycarbonate resin having a molecular weight of from about 20,000 to about 50,000 available as Merlon from Mobay Chemical Company and poly(4,4′-diphenyl-1,1-cyclohexane carbonate). Methylene chloride solvent is a particularly desirable component of the charge transport layer coating mixture for adequate dissolving of all the components and for its low boiling point. However, the type of solvent selected depends on the specific resin binder utilized.

In all of the above charge transport layers, the activating compound which renders the electrically inactive polymeric material electrically active should be present in amounts of from about 15 to about 75 percent by weight.

If desired, the charge transport layer may comprise any suitable electrically active charge transport polymer instead of a charge transport monomer dissolved or dispersed in an electrically inactive binder. Electrically active charge transport polymer employed as charge transport layers are described, for example in U.S. Pat.

Nos. 4,806,443, 4,806,444, and 4,818,650, the entire disclosures thereof being incorporated herein by reference.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

Thus, this invention extends the life of electrostatographic imaging members. The water insoluble high molecular weight unmodified hydroxy methacrylate polymers of this invention contain a hydroxyl group and carbonyl containing (ester) functionality in each repeat unit for blocking hole injection in the dark and transporting photodischarged electrons. The blocking layers of this invention form a solvent barrier layer to most of the commonly used coating solvents used to coat the layers overlying the blocking layer, e.g. is substantially insoluble in solvents such as toluene, tetrahydrofuran and methylene chloride. The expression "substantially insoluble" as employed herein is defined as not sufficiently soluble to erode away a blocking layer in the time period that these solvents are in contact with the blocking layer so that high charge acceptance ($V_O$) and low ($V_R$) are retained in at least 200 consecutive imaging cycles. High $V_O$ is defined as at least 600 volts and low $V_R$ is defined as less than about 100 volts. It is electrically hole blocking during and after corotron charging prior to photodischarge. It is also more dark stable. This prevents ground plane hole injection and enables high $V_O$ charging initially and with repetitive cycling. The blocking layers of this invention electrically accept photodischarged electrons from the generator layer and transport most or all of the accepted electrons to the ground plane to complete the discharge process. Thus, the electrostatographic imaging member of this invention allows photodischarge with low residual voltage during cycling under most ambient relative humidities. This enables total discharge within the xerographic time scale, and thus low $V_R$ initially and with repetitive cycling. The water insoluble high molecular weight unmodified hydroxy methacrylate polymers of this invention also afford sufficiently thick blocking layers in one or two spray passes from low viscosity, more concentrated solutions compared to other materials such as viscous poly(vinylalcohol) aqueous solutions which require numerous spray coating passes to build up blocking layer dry thickness to the desired level. In addition, the co-presence of the carbonyl functionality in each repeat unit enhances hydroxy polymer solubility (versus PVOH) to generally include lower alcohols and glycol ethers as optional spray solvents which make higher quality coatings more likely. Further, after solvent evaporation the hydroxy polymers, because of their dipole interactions (ester) with the conductive layer polymers, enhance solid state adhesion at this interface compared to materials such as poly(vinylalcohol). A particularly surprising aspect of the high molecular weight blocking layers of this invention is the lack of a strong dependence upon a large amount of H-bonded water to assist photodischarged electron injection and transport. Devices containing the high molecular weight blocking layers of this invention can function independent of relative humidity without the need to provide an enclosed humidifier in the xerographic engine.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

The hole blocking capability of the various water insoluble high molecular weight unmodified hydroxy methacrylate polymeric materials used as blocking layers were evaluated to establish the hole injecting capability of various non-metallic conductive layers. This was accomplished in this Control Example by measuring the first cycle surface voltage in the dark immediately after corotron charging (~0.2 seconds) photoreceptors not containing a hole blocking layer. This value was thereafter compared in the following Examples to the first cycle surface voltage obtained on an otherwise identical photoreceptor, but with the polymeric hole blocking layer included. The larger the difference [$V_{O(1)}$ with blocking layer minus $V_{O(1)}$ without blocking layer] in measured voltages under a constant set of electrical testing conditions for two photoreceptors having approximately the same layer thicknesses and same conductive layer, the larger is the intrinsic ability of the hole blocking layer material to block hole injection. The photoreceptors were fabricated without hole blocking layers in this Example and with hole blocking layers in all the remaining Examples. The conductive layers used in this evaluation consisted of a conductive material, usually (but not always) dispersed in an insulative polymeric binder, at a given loading level (>10 weight percent) sufficient to function as a conductive ground plane in discharging the photoreceptor over many consecutive charge-erase (discharge) cycles.

Carbon Impregnated Tedlar® (CIT) Conductive Layer

A 3 mil thick conductive composite film (CIT) of conductive carbon impregnated in polyvinylfluoride (PVF) (commercially available from E. I. duPont De Nemours & Co.) was coated with the overlying photoreceptor layers. The CIT combines the functions of the conductive layer with the polymeric substrate into one layer. The expression CIT refers to carbon impregnated Tedlar®. Tedlar® is polyvinylfluoride without carbon black dispersed in it (also available from, E. I. duPont De Nemours & Co.). The loading level of the conductive carbon black in carbon impregnated Tedlar® was between 10–25 weight percent, and the film physically and electrically resembles polyvinylfluoride loaded with 15 weight percent conductive carbon black Black Pearls 2000 (available from Carbot Corp.). CIT has sufficiently conductive resistivity ($\leqq 10^5$ ohms/-square), when measured with a four point probe, to be used successfully in numerous consecutive xerographic charge-discharge cycles.

Polyvinylfluoride coatings, with or without impregnated conductive carbon black, are chemically and physically resistant to common organic solvents (below 100° C.) such as methylene chloride, tetrahydrofuran (THF), and toluene which are frequently used coating solvents for the other layers in these devices. In addition, the same PVF coatings are similarly solvent resistive to the more polar solvents such as lower alcohols (methanol, ethanol, isopropanol, n-butanol, sec. butanol and isobutanol) and ketones (acetone, methylethyl ketone and methyl isobutyl ketone) and water.

Crosslinked Carboset®/Carbon Black Conductive Layer

Conductive layer carbon black formulations were developed for both drawbar and spray coating fabrication. The drawbar coated formulation consisted of 6.87 grams polyacrylic resin (Carboset® 514A, available from B. F. Goodrich Co. as a 70% solution in isopropanol) diluted with 20.4 grams isopropanol and 7.5 grams methylisobutyl ketone (MIBK). To this solution was added 0.94 grams of a conductive carbon black (Black Pearls® 2000 from Cabot Corp.) which was suspended with a Paint Shaker (Red Devil, Inc. Model 5100X) for 90 minutes. Finally 0.51 gram of XAMA-2 (a Carboset crosslinking agent available from Virginia Chemicals) was added and the dispersion was shaken for 15 minutes on the paint shaker. The resulting carbon black dispersion with crosslinking agent was drawbar coated (2 mil gap) using a Model P290 Gardner Labs, Inc. 8½"×11" drawbar coater now available from Pacific Scientific. This carbon black conductive layer dispersion was coated onto insulative polymeric substrates, such as duPont's Tedlar® or Mylar film or Melinex Polyester (ICI), and was then dried for one hour ambiently and one hour at 100°–120° C. in an air convection oven.

The dry thickness of the conductive layer was about 10±5 micrometers wherein the useful conductivity range was not a function of thickness. The resulting dried conductive layer was a crosslinked network wherein the conductive carbon black particles are trapped in the polymeric network.

Carboset-carbon black conductive layers were also spray coated onto insulative polymeric substrates (e.g. Tedlar®, Mylar, Melinex®). The dispersion formulation used in spray coating was 80 grams Carboset 514A, 9.9 grams Black Pearls® 2000 conductive carbon black, 400 grams isopropanol and 1000 grams methylisobutyl ketone. All solvents used in this work were reagent grade. The above dispersion was roll milled with glass beads, for 64 hours. After decanting away the dispersion from beads, 8.4 grams XAMA-2 (the crosslinking agent) was added and magnetically stirred into the dispersion for 0.25 hour. The dispersion was sprayed using commercially available spray guns and equipment manufactured by Binks Manufacturing Company. A Binks Model 21 automatic spray gun was used in a Binks spray booth Model BF-4 with a type 42753 reciprocator. The Model 21 gun was equipped with a 63B fluid nozzle and a 63 PE air atomization nozzle. The fluid pressure was 4 psi and the spray atomization pressure was 50 psi. The needle setting was at 1.5 turns and the spray fan angle at 0.75 turns. These settings were counted from the closed position. The spray gun was operated in an automatic mode and was traversed on a reciprocator while spraying from top to the bottom of the vertically positioned mandrel. The insulative polymeric substrates sprayed were tape mounted and rotated on a cylindrical aluminum mandrel positioned on a shaft connected to a turntable. The conductive dispersion was spray cycled three times with 1.5 minutes elapsing between passes. Finally, the coating was removed from the mandrel and was dried at 120° C. for 0.5 hour in an air convection oven. Thus, the crosslinked conductive layer (drawbar or spray coated) functions as a solvent barrier preventing erosion thereof by subsequently used coating compositions and their solvents. Because of the maintained layer integrity, proper xerographic charging and discharging results over thousands of cycles.

The crosslinking chemistry between XAMA-2 and Carboset® 514A is explicitly illustrated in a technical brochure published by the B. F. Goodrich Co. entitled Carboset Resins for Permanent Coatings.

Black Conductive Olefinic Flash Primer LE16610 Conductive Layer

A conductive carbon black and a polymeric resin in a 60/40 by volume solvent mixture of toluene and xylene (Black Conductive Olefinic Flash Primer LE16610, available from the Red Spot Paint and Varnish Co., Inc.) was spray coated as received (without dilution) to give a 10–16 micrometer thick conductive layer that was sufficiently conductive to function as a ground plane for numerous consecutive xerographic charge-discharge cycles.

The LE16610 black conductive olefinic flash primer (600 grams) was also redispersed ($\geqq$0.5 hour.) using the previously described paint shaker (no steel shot or glass beads used). To spray a 12 micrometer thick (after drying) coating, four passes were applied according to the following set of spray parameters.

Atomization Pressure: 55 psi
Fluid Pressure: 6 psi
Fan Angle: 0.75 turns from closed position
Fluid Opening: 1.25 turns from closed position The previously described spray guns and associated equipment manufactured by the Binks Manufacturing Company were also used to spray this conductive layer composition on the same insulative polymeric substrates, mounted as previously described. The coated substrates were then ambiently air dried for 1–16 hours and at 90° C. in an air convection oven for at least 0.25 hour.

Polypyrrole ICP-117 Conductive Layer

In a typical formulation for drawbar coating a conductive layer, 20 grams of Polaroid ICP-117 polypyrrole-polymer complex at 10 weight percent in ethyl acetate was diluted with 10 grams of the same solvent. This dispersion was drawbar coated (0.5 mil gap) with the previously described Gardner coating apparatus onto an insulative polymeric substrate, such as Mylar or Tedlar® from duPont. The coated conductive layer on the insulative polymeric substrate was transferred to an air convection oven maintained at 100°-120° C. for 0.5 to 1.0 hour to evaporate the coating solvent. Polaroid ICP-117 polypyrrole-polymer complex is negatively charged and the polypyrrole fragments are positively charged. However numerous copolymer compositions were employed which were capable of being charged negatively and these are described in two publications: (1) S. J. Jasne and C. K. Chiklis, Synthetic Metals, 15 175-182 (1986) and (2) European Patent Application, No. 85103447.0 filed Mar. 23, 1985.

Copper Iodide Conductive Layer

Conductive layers were drawbar and spray fabricated from commercially available copper iodide. The coatings prepared by drawbar fabrication will first be described.

Ultra pure cuprous iodide (2.30 grams) available from most chemical suppliers such as Aldrich Chemical Co. and Alfa-Ventron Research Chemicals and Materials, was mixed with pure butyronitrile solvent (100 ml) and the mixture was magnetically agitated for 4-16 hours at room temperature until a saturated solution formed. The trace amount of excess undissolved cuprous iodide was removed in a pressured (40 psi) filtration through a Nuclepore Filinert polycarbonate membrane (47 mm diameter) having a porosity of 0.2 microns. The clear filtrate was drawbar coated using a 6 mil bar gap and the coating was dried for one hour ambiently and then for at least 10 minutes in an air convection oven at 100° C. The dried coating thickness ranged from 200-1000 Angstroms as measured with an Auto EL elipsometer (Rudolph Research) at a wavelength of 6328 Angstrom.

The spray fabricated conductive copper iodide coatings are next described. To one liter of reagent grade butyronitrile solvent was added 23 grams of ultra pure cuprous iodide and the mixture was magnetically agitated at room temperature for two hours. The resulting solution [2.3 weight solute/volume solvent percent (w/v %)] was pressure filtered through a 0.2 micrometer Nuclepore filter at about 40 psi, and the filtrate was spray coated in 1 or 2 passes on either Mylar or Tedlar substrates. The transparent cuprous iodide coating ranged in thickness from 50 to 500 Angstroms.

The following set of spray parameters were used to spray the above solution in 2 passes:

Atomization Pressure: 55 psi

Fluid Pressure: 5 psi

Fan Angle: 0.75 turns from closed position

Fluid Opening: 0.75 turns from closed position.

The previously described spray guns and associated equipment manufactured by the Binks Manufacturing Company were used to spray this conductive layer composition, mounted as previously described. The sprayed conductive layers were allowed to ambiently dry for at least one hour and were then air convection oven dried for at least 0.5 hour.

Optionally a mixed nitrile saturated solution, comprising 515 ml butyronitrile, 345 ml acetonitrile (60:40 by volume) and 23.2 g cuprous iodide (2.7 w/v %), was filtered as described above and the filtrate was spray coated in 1 or 2 passes (1.5 minutes between passes) to give conductive layer coatings as described above for the single solvent spray solution. Similar drying conditions were employed but the spray parameters were slightly different:

Atomization Pressure: 55 psi

Fluid Pressure: 4 psi

Fan Angle: 0.5 turns from closed position

Fluid Opening: 0.5 turns from closed position.

These spray fabricated coatings were found to be equally useful to drawbar coated conductive layers.

The above conductive layers were fabricated (drawbar or sprayed) or used in the as received coated form (such as carbon impregnated Tedlar) as ground planes on which the other photoreceptor layers were fabricated. In this Example the water insoluble high molecular weight unmodified hydroxy methacrylate polymer blocking layers were deliberately omitted to establish the hole injection severity of representative conductive layer coatings. The devices fabricated in this example did not contain an adhesive layer between the conductive layer and the photogenerator layers except when the conductive layer was binderless cuprous iodide. In this case delamination occurred between the cuprous iodide layer and the photogenerator layer with routine handling of the completed device. To avoid delamination and thereby obtain charge-erase electrical evaluation, a very thin (<0.1 micrometer) poly(4-vinylpyridine) [P(4VPy)] adhesive layer was drawbar coated between the conductive layer and photogenerator layer. A typical poly(4 vinylpyridine) adhesive layer formulation consisted of a 0.6 weight percent solution of 0.12 g Reillene® 4200 (Reilly Tar & Chemical Co.) in 17.89 g isobutanol and 1.99 g isopropanol. After applying this solution as a coating with a 0.5 mil drawbar gap, using the previously described Gardner coating apparatus, the coating was dried ambiently for one hour and then for one hour at 100° C. in an air convection oven (standard conditions). When the poly(4vinylpyridine) adhesive layer was drawbar fabricated in devices of subsequent examples, the above formulation, coating procedure and drying conditions were used unless otherwise indicated.

A charge generator layer mixture was prepared by forming a dispersion of about 8.57 g trigonal selenium particles doped with about 1-2 percent by weight sodium hydroxide, 16.72 g polyvinylcarbazole, 4.93 g N,N'-bis-(3''-methylphenyl)-[1,1'-biphenyl]-4,4'-diamine, 100.55 g tetrahydrofuran and 100.55 g toluene. This dispersion was then diluted with an equal weight of toluene. The diluted dispersion was next agitated on a wrist shaker for about 5 minutes immediately prior to coating the conductive layer with a 1 ml drawbar gap. The charge generator coating was next dried for one hour at room temperature and for one hour at 100° C. in an air convection oven. The dry thickness of the photogenerator layer thus obtained was about 1.0±0.3 micrometer in this and subsequent Examples.

A charge transport layer coating mixture was prepared by mixing about 2.8 g N,N'-bis(3''methylphenyl)-[1,1'biphenyl]-4,4''diamine, 4.2 g polycarbonate resin (Makrolon® 5705, available from Farbenfabricken Bayer A. G.) and 40 g methylene chloride. This mixture was coated with a 5 mil drawbar gap onto the photogenerator layer. The transport layer coating was dried at room temperature for one hour, and then through an incremental heating cycle from 50° to 100° C. in 0.50 to 0.75 hour and finally at 110° C. for at least 10 minutes. The dry thickness of the charge transport layers in this and subsequent Examples was about 25-30 micrometers as determined with a type DS No. 11033 Permoscope. The completed devices were electrically charge-erase cycled using either an ambient scanner or an environmental scanner which are described below.

The ambient cyclic scanner used to obtain the charge-erase cycling results, was equipped with a single wire corotron (5 cm wide) set to deposit $9\times10^{-8}$ coulombs/cm$^2$ of charge on the surface of these experimental devices. The devices were grounded to an aluminum drum having a 76.5 cm circumference and the drum was rotated at a speed of 12 rpm giving a surface speed of 6 inches per second. The devices were discharged (erased) with a tungsten white light source emitted through a plexiglass light pipe and the intensity of the erase lamp was varied from 2 to 10X the amount of light required to discharge the device down to twice the asymptotic residual voltage. The entire xerographic simulation (charge and erase) was carried out in a light tight enclosure. Some environmental changes, such as low RH via purging with dry air and high RH via purging with moist air were made during some of the tests to obtain cyclic results under non-ambient conditions.

The environmental cyclic scanner used to obtain charge-erase cycling results under various environmental conditions, was equipped with a single wire corotron (5 cm wide) set to deposit $9\times10^{-8}$ coulombs/cm$^2$ (or $14\times-10^{-8}$ coulombs/cm$^2$ in some cases) of charge on the surface of these experimental devices. The devices were grounded to an aluminum drum having a 63.1 cm circumference and the drum was rotated at a speed of 20 rpm to produce a surface speed of 8.3 inches per second. The devices were discharged (erased) with a short arc white light source emitted through a fiber optic light pipe. The entire xerographic simulation (charge and erase) was carried out in an environmentally controlled light tight chamber. The devices, without blocking layers in this Example, were charge-erase tested for 200 cycles at ambient RH. Ambient RH for all devices charge-erase cycled in this application was between 12 and 60%. Low RH charge-erase testing conditions when used were $\leqq$5% and the test was run after first equilbrating the devices at low RH overnight.

TABLE A

| Device # | Conductive Layer (Fabrication Method) | $V_{O(1)}$ | $V_{O(200)}$ | $V_{R(1)}$ | $V_{R(200)}$ |
|---|---|---|---|---|---|
| Ia | duPont CIT (prefabricated) | 420 | 330 | 32 | 36 |
| Ib | B. F. Goodrich Carboset ® 514A (drawbar) | 460 | — | 10 | — |
| Ic | Red Spot ® LE16610 (sprayed) | 600 | 440 | 36 | 65 |
| Id | Polaroid ICP-1 17 (drawbar) | 200 | 180 | 22 | 25 |
| Ie | Cul (drawbar) | 90 | 90 | 4 | 4 |

The ambient cyclic scanner was employed to produce the data in TABLE A. This data in TABLE A indicates inferior charging levels [$V_{O(1)}$]. After charging these photoreceptors in the dark, hole injection from the conductive layer was unimpeded (no hole blocking layer) and so the negative surface charge was extensively neutralized prior to the first voltage measurement (~0.2 sec. after charging). The numerous examples which follow will show major improvement in the initially measured voltage [higher $V_{O(1)}$] and in retention of $V_O$ after 200 cycles or more because of the use of suitable hole blocking layer materials interposed between the conductive layer and the photogenerator layer.

EXAMPLE II

This Example demonstrates the selection of a preferred poly(4vinylpyridine) [P(4VPy)] thickness (coating concentration) as an adhesive layer between poly(2-hydroxyethylmethacrylate) [P(HEMA)] blocking layers and generator layers containing trigonal selenium particles dispersed in polyvinyl carbazole (PVK). When the P(4VPy) adhesive layer is too thick or is bulk mixed into the P(HEMA) to give phase separated (immiscible) blocking layer compositions, $V_R$ cycle-up is immediately apparent (see following TABLE B). In contrast devices IIc & IId (described in detail below), which have no P(4VPy) adhesive layer, have no significant $V_R$ cycle-up. All the P(4VPy) containing devices (IIa & IIb) in the Table B of this Example show considerable $V_R$ cycle-up suggesting the P(4VPy) generates $V_R$ cycle-up. The layered P(4VPy) containing devices (IIa and IIb) exhibit a smaller $V_R$ cycle-up than the mixed P(4VPy)-P(HEMA) devices (IIe–IIg) implying a second mechanism for $V_R$ cycle-up may be operative in the mixed blocking layer devices.

The $V_R$ cycle-up in both the layered and mixed devices arises to some extent from P(4VPy) migration into the generator and/or transport layer during coating of these layers. The migrated P(4VPy) polymer in the generator and/or transport layer traps holes during device discharge thus causing $V_R$ cycle-up. The P(4VPy) migration is more prevalent when larger amounts (thicker layers) of P(4VPy) are present in the adhesive composition. Since P(4VPy) is methylene chloride soluble, considerable migration of P(4VPy) occurs during coating of the transport layer. Some of the P(4VPy) directly in contact with P(HEMA) will not migrate because the strong H-bonding interaction between the P(4VPy) and the P(HEMA) will anchor the former. However, when an excess amount of P(4VPy) reside in the P(HEMA), solvent assisted P(4VPy) migration still occurs because there is an insufficient number of H-bonds per polymer chain, on the average, to anchor all the P(4VPy) polymer in the P(HEMA).

The second $V_R$ cycle-up mechanism, which occurs primarily in devices having a mixed p(4VPy)-P(HEMA) layer, results from electron trapping in these blocking layers during discharge. High molecular weight unmodified hydroxy methacrylate polymer blocking layers possess extensive hydroxyl-hydroxyl H-bonding which structurally resembles water in its H-bonded state. It is presumed that photodischarged electrons migrate through the hydroxy ester polymer blocking layer medium (plus the small amount of H-bonded water contained therein) much like electrons migrate through water. Thus, when P(4VPy) H-bonds to hydroxyl groups in the bulk P(4VPy)-P(HEMA) blocking layers, many of the hydroxyl-hydroxyl H-bonding sites are disrupted. This decreased hydroxyl-hydroxyl H-bonding density results in blocking layer areas deficient in electron transport capability and electron trapping results contributing to the $V_R$ cycle-up. Thus, the $V_R$ cycle-up is about twice as large in the mixed P(4VPy)-P(HEMA) blocking layer devices (IIe–IIg) versus the layered devices (IIa–IIb). The charge-erase cycling data were obtained at ambient RH using the ambient scanner for 12000 cycles.

TABLE B

| Device No. | Conductive Layer | Adhesive-Blocking Layer(s) Composition | Thickness (micrometer) | $V_{O(1)}$ | $V_{O(12K)}$ | $V_{R(1)}$ | $V_{R(12K)}$ |
|---|---|---|---|---|---|---|---|
| IIa | Carboset ® 514A | P(4PVPy)–P(HEMA) | 0.8–1.0 @ layer | 1360 | 1320 | 70 | 160 |
| IIb | CIT | P(4PVPy)–P(HEMA) | 0.8–1.0 @ layer | 1280 | 1240 | 56 | 130 |
| IIc | Carboset ® 514A | P(HEMA) | 0.8–1.0 | 1020 | 680 | 30 | 40 |
| IId | CIT | P(HEMA) | 0.8–1.0 | 1200 | 1180 | 28 | 56 |
| IIe | Carboset ® 514A | P(4VPy)–P(HEMA) 1:1[a] | 0.8–1.0 | 1440 | 1600 | 40 | 270 |
| IIf | Carboset ® 514A | P(4VPy)–P(HEMA) 2:1[a] | 0.8–1.0 | 1200 | 1440 | 92 | 300 |
| IIg | Carboset ® 514A | P(4VPy)–P(HEMA) 1:2[a] | 0.8–1.0 | 1360 | 1600 | 48 | 290 |

[a]Repeat unit molar ratios: The repeat unit molar ratio is the weight in grams of each polymer in the polymer blend corresponding to the product of a constant (any positive number) times the molecular weight of the repeat unit of each polymer. The molecular weight of the repeat unit of each polymer is calculated in the same manner as molecular weights for non-polymeric materials. The polymeric repeat unit molecular weight is the product of the atomic weight of each atom in the repeat unit times the number of atoms summed for all the atoms in the repeat unit. The repeat unit molecular formulae for P(HEMA) and P(4VPy) are $C_6H_{10}O_3$ and $C_7H_7N$, and the repeat unit molecular weights are 130.15 and 105.14 respectively.

The Carboset 514A conductive layers on Tedlar ® substrates were drawbar coated for devices IIa and IIc and were spray coated for devices IIe–IIg. The formulations, coating conditions and drying conditions for both fabrication methods were described in Example I. The as received carbon impregnated Tedlar ® (CIT) bulk conductive substrates were drawbar coated with the P(HEMA) blocking layer solution.

In devices IIa–IId, with blocking layers containing only one polymer, the P(HEMA) (0.6 gram) was coated from a 6 weight percent solution in methanol (9.4 grams). The same formulation was used to coat the thick P(4VPy) adhesive layer in devices IIa and IIb and a 0.5 mil drawbar gap was used for both layers. Standard drying conditions were employed for both layers wherein standard drying conditions are one hour at ambient conditions and one hour at 100° C. in an air convection oven. The water insoluble P(HEMA) used in the above TABLE B was obtain from Polysciences, Inc. (see Example IV) and the P(4VPy) from the Reilly Tar & Chemical Co. as Reillene ® 4200.

For devices (IIe–IIg) containing both P(HEMA) and P(4VPy) as a mixed polymer blocking layer composition, approximately 6 weight percent solutions of the combined polymers were prepared in 90:10 (by weight) of 2,2,2-trifluoroethanol and 1,1,1,3,3,3-hexafluoroisopropanol. Both polymers dissolved in the acidic alcohol mixture whereas a non-coatable gummy precipitate formed in methanol thus precluding non-fluorinated alcohols as coating solvents. Standard blocking layer drawbar gap (0.5 mil) and drying conditions (as defined above) were employed. The compositions of the coating solutions are described in the following TABLE C.

TABLE C

| Device No. | REPEAT UNIT MOLAR RATIO P(4VPy) P(HEMA) | P(4VPy) m Mole | P(4VPy) m Grams | P(HEMA) m Mole | P(HEMA) m Grams |
|---|---|---|---|---|---|
| IIe[a] | 1:1 | 5.00 | 0.65 | 5.00 | 0.53 |
| IIf[a] | 2:1 | 6.93 | 0.73 | 3.47 | 0.45 |
| IIg[a] | 1:2 | 3.23 | 0.34 | 6.46 | 0.84 |

[a]Solutions were prepared in 16.68 grams trifluoroethanol and 1.86 grams hexafluoroisopropanol.

In order to identify a useful blocking layer thickness window, it was necessary to obtain a coating solution concentration versus dry coating thickness relationship for the blocking layer polymers and adhesive layer polymers when using a 0.5 mil drawbar gap to coat these layers. The blocking layer polymer, poly(2-hydroxypropylmethacryate) P(HPMA), was coated onto smooth 2"×2" glass substrates from a 90:10 by weight solvent mixture of isobutanol:isopropanol at four concentrations, 1.2, 3.6, 6.0 and 8.4 weight percent, after drying as described above (standard conditions) and the dry thickness of the coatings was measured with a Dektak ® surface profile measuring system. The Dektak ® is available from Sloan Technology Corp. (Model #900050) and uses a hemispherical diamond stylus of 0.0001" radius to make the measurement. This instrument measures thickness by drawing the stylus over the coated surface and then off the coated edge onto the high tolerance uncoated smooth glass (Corning #7059) surface. The vertical step from the coated surface to the smooth glass surface is simultaneously amplified and recorded on thickness calibrated graph paper enabling rapid measurement of the step and thus the thickness. Dektak ® steps were measured at four different surface locations in each of three coatings made from a given concentration of P(HPMA). For a given coating, a 2–6 percent thickness variation was found, and the thickness variation among the three coatings made from the same concentration of P(HPMA) was always less than 10 percent. These measurements enabled coating thickness ranges as indicated in Example I and the above table, and in all subsequent tables of this embodiment. Using the P(HPMA) dry coating thickness versus concentration curve for other amorphous organic polymers and copolymers, coated from sufficiently viscous solutions which totally fill the 0.5 mil drawbar gap, is a valid extension of the correlation because these polymers have similar densities. Thus, the thickness will reside within the cited ranges.

To further illustrate the effect of increasing P(4VPy) thickness on $V_R$ cycle-up, the P(4VPy) adhesive layer thickness was systematically increased on top of a P(HEMA) blocking layer of constant (0.8–1.0 micrometer) thickness. The P(HEMA) used in this segment of this Example was the water insoluble very high molecular weight variety available from Scientific Polymer Products, Inc. (Example IV) which was coated and dried as described above for the water insoluble high molecular weight P(HEMA) obtained from Polysciences. Instead of formulating the blocking layer solution in methanol, Dowanol ® PM was used as the coating solvent again at 6 weight percent as previously described. Dowanol ® PM, available from Dow Chemical Co., is a glycol methyl ether systematically named as 1-methoxy-2-hydroxypropane.

The P(4VPy) adhesive layers were coated and dried as previously described in Example I formulated in the 90:10 by weight estimated from the Dektak ® generated P(HPMA) calibration curve. For estimated from the Dektak ® generated P(HPMA) calibration curve. For concentrations less than 1.2 weight percent and greater than 8.4 weight percent, thicknesses were estimated from the Dektak ® curve extrapolated at either end. Thus, P(4VPy) concentrations of 0.0, 0.3, 0.6, 1.2, 2.5, 5.0 and 10.0 weight percent correspond to the estimated adhesive layer thicknesses in the following table. The precise thickness of the P(4VPy) adhesive layer is unimportant so long as the coating concentration and drawbar gap can be correlated to an electrically useful charge-erase window. The bulk conductive substrate, carbon impregnated Tedlar (CIT), was used for all the devices in this adhesive layer thickness study. All devices electrically tested in this Example (both tables) contain charge generator and transport layers formulated, coated and dried as described in Example I. The charge-erase cycling data in the following table were obtained at ambient RH using the environmental scanner for 200 cycles.

TABLE D

| Device No. | P(4VPy) Adhesive Layer (Approx. thickness) (micrometer) | $V_{O(1)}$ | $V_{O(200)}$ | $V_{R(1)}$ | $V_{R(200)}$ |
|---|---|---|---|---|---|
| IIh | 0.0 | 1095 | 1115 | 55 | 50 |
| IIi | 0.03 | 880 | 890 | 40 | 40 |
| IIj | 0.06 | 925 | 935 | 40 | 40 |
| IIk | 0.12 | 940 | 975 | 45 | 50 |
| IIl | 0.25 | 1090 | 1120 | 55 | 65 |
| IIm | 0.50 | 875 | 950 | 50 | 70 |
| IIn | 1.00 | 945 | 1045 | 70 | 95 |

The above data in TABLE D indicates a $V_R$ cycle-up in 200 cycles starting at about 0.25 micrometer P(4VPy) which corresponds to a coating solution concentration of 2.5 weight percent. The $V_R$ cycle-up ($V_{R(200)}$-$V_{R(1)}$) becomes progressively larger (from 10 to 25 volts) with increasing P(4VPy) thickness. Adhesive layer thicknesses between 0.03 and 0.12 micrometer, corresponding to a P(4VPy) concentration range of 0.3 to 1.2 weight percent, provide a useful adhesive layer thickness window wherein sufficient adhesion is provided for routine handling without delamination, and acceptable charge-erase cycling data is obtained.

The initial charge acceptance, which is maintained in all devices for 200 cycles and in most of the devices for 12000 cycles, indicates the 0.8–1.0 micrometer P(HEMA) hole blocking layer is minimizing charge injection from the carbon based conductive layers. The latter charge at a much lower level (Example I) when the blocking layer is omitted in an otherwise identical device.

EXAMPLE III

This example illustrates the use of P(4VPy) and P(2VPy), available from Reilly Tar & Chemical Co. as Reillane ® 4200 and 2200 respectively, as a combined hole blocking and adhesive layer in a failed attempt to eliminate the need for a water insoluble high molecular weight unmodified hydroxy methacrylate polymer blocking layer. This Example will first describe a device set in which all the layers were drawbar coated, and then a second device set in which all the layers were spray coated. Both device sets were fabricated on carbon black conductive layers but in the second set a metallic conductive layer (titanized Mylar) was also included to evaluate the impact of the conductive layer on charge-erase electrical performance. The adhesive/blocking layers of the first device set were formulated, drawbar coated and dried as described in the following table.

TABLE E

| Device No. | Conductive Layer[a] Tedlar Substrates | Adhesive/Blocking Layer Formulations: Weight % P(VPy) (micro meter)[b] | Grams P(VPy) | Grams Solvent(s) |
|---|---|---|---|---|
| IIIa[c] | CIT | 6 (0.8–1.0) | 0.3 P(4VPy) + 0.3 P(2VPy) | 5.64 isopropanol + 3.76 isobutanol |
| IIIb[d] | CIT | 1.5 | 0.15 P(4VPy) | 9.85 t-butanol |
| | | 1.5 (0.20–.25 each) | 0.15 P(2VPy) | 5.91 isopropanol + 3.94 isobutanol |
| IIIc[c] | Carboset 514A | 6 (0.8–1.0) | 0.3 P(4VPy) 0.3 P(2VPy) | 5.64 isopropanol + 3.76 isobutanol |
| IIId[d] | Carboset 514A | 1.5 | 0.15 P(4VPy) | 9.85 t-butanol |
| | | 1.5 (0.20–.25 each) | 0.15 P(2VPy) | 5.91 isopropanol + 3.94 isobutanol |

[a]Conductive layers & Carboset drawbar procedure described in Example I.
[b]Thicknesses based on Dektak ® measurement (Example II) and all coatings fabricated with 0.5 mil gap and dried using standard conditions.
[c]One adhesive/blocking layer coating from combined polymer solution.
[d]P(4VPy) adhesive blocking layer coated over P(2VPy) blocking layer from two polymer solutions.

After coating the above adhesive/blocking layers, the devices were completed by sequentially drawbar coating the charge generator and transport layers; the formulation, coating and drying conditions for which were described in Example I.

Charge-erase electrical cycling of the completed devices was effected at ambient RH using the ambient cyclic scanner for 12,000 cycles

TABLE F

| Device No. | Conductive Layer | Adhesive/Blocking Layers Composition/Thickness[a] | $V_{O(1)}$ | $V_{O(12K)}$ | $V_{R(1)}$ | $V_{R(12K)}$ |
|---|---|---|---|---|---|---|
| IIIa | CIT | P(4VPy)–P(2VPy) 0.8–1.0 | 1240 | 1320 | 110 | 305 |
| IIIb | CIT | P(4VPy)/P(2VPy) 0.20–.25 each | 1220 | 1110 | 80 | 200 |
| IIIc | Carboset 514A | P(4VPy)–P(2VPy) 0.8–1.0 | 1160 | 1200 | 75 | 180 |
| IIId | Carboset 514A | P(4VPy)/P(2VPy) 0.20–.25 each | 700 | 800 | 40 | 150 |

[a]Thicknesses in micrometers.

The $V_R$ cycle-up observed for all four devices indicates devices IIIb and IIId, which were intended to have a layered structure of poly(vinylpyridine) isomers, in fact, have mixed significantly. Apparently the initially layered structures in IIIb and IIId mix extensively during coating of the charge transport layer from methylene chloride which is a solvent for both poly(vinylpyridine) isomers. In addition, the THF used to coat the charge generator layer may channel through the top P(4VPy) layer to dissolve the underlying P(2VPy) which would promote interlayer mixing between the two P(VPy) layers and also between the P(VPy) layers and the PVK generator layer binder. Since the P(2VPy) isomer is soluble in both methylene chloride and THF and the P(4VPy) isomer is soluble only in methylene chloride, it is very likely that the more soluble P(2VPy) migrates upward into the charge generator and transport layers more extensively than does the P(4VPy) isomer. Thus, the $V_R$ cycle-up reflects the presence of hole trapping P(2VPy) in the charge active layers.

Although the water insoluble high molecular weight unmodified hydroxy methacrylate polymer is not necessary to prevent conductive layer hole injection in these mixed P(VPy) isomer blocking layer devices ($V_o$ values are large), its presence is necessary to help anchor the P(VPy) isomers through hydrogen bonding to the P(HEMA) hydroxyl groups. This anchoring reduces or substantially eliminates [when a thin layer of P(VPy) isomer is used] hole trapping P(VPy) migration into the charge active layers during coating thereof and so $V_R$ cycle-up decreases. The P(4VPy) anchoring mechanism by P(HEMA) is described in Example II and also applies to P(2VPy), but probably to a lesser extent because H-bonding to P(2VPy) is more sterically hindered than to P(4VPy). Thus, the P(2VPy) is more free to migrate during coating than is the P(4VPy) because of solubility and H-bonding considerations.

The totally sprayed second device set of this Example will next be described. The Carboset 514A carbon black conductive layer was formulated, spray fabricated onto Mylar and dried as described in Example I, and the titanized Mylar was used as received from E. I. duPont de Nemours & Co. These substrate-conductive layers were next spray coated with a dilute solution (0.9 weight percent) of either P(VPy) isomer in mixed alcohol solvents. The spray solution was formulated by mixing 6.86 grams of P(4VPy) or P(2VPy) with 663.6 grams isobutanol and 79.6 grams isopropanol in an amber quart bottle which was roll milled for 2–5 hours to obtain a solution. This blocking layer solution was sprayed using commercially available spray guns and equipment manufactured by Binks Manufacturing Co. The Binks Model 21 automatic spray gun was used in the Binks spray booth Model BF-4 with a type 42753 reciprocator. The Model 21 gun was equipped with a 63B fluid nozzle and a 63PE air atomization nozzle. The fluid pressure was 4 psi and the spray atomization pressure was 55 psi. The needle setting was at 0.75 turns and the spray fan angle at 0.50 turns counted from the closed position. The spray gun was operated in an automatic mode and was traversed on a reciprocator while spraying from the top to the bottom of the vertically placed mandrel. The substrate-conductive layer sheets to be sprayed were tape mounted and rotated on a cylindrical aluminum mandrel positioned on a shaft connected to a turntable. The blocking layers solution was spray cycled with two or four passes with 1.5 minutes elapsing between passes. Finally, the coating was removed from the mandrel and was dried at 120° C. for 5 minutes in an air convection oven. The dry thickness of these sprayed P(VPy) blocking layers, although not measured, is estimated for the two pass layer to be between 0.5 to 1.5 micrometer and for the four pass blocking layer to be between 1.5 to 2.5 micrometer.

The generator layer mixture was then formulated for spray fabrication using the masterbatch formulation described in Example I. To 200 grams of the generator layer masterbatch in a one quart amber glass bottle was added 258 grams of toluene and 258 grams of THF and this mixture was magnetically stirred for 3–4 hours prior to spray coating. The dispersion (3.65 weight percent total solids) was sprayed using the previously described Binks equipment. The fluid pressure was 4 psi and the spray atomization pressure was 55 psi. The needle setting was at 0.75 turns and the spray fan angle at 0.5 turns counted from the closed position. The spray gun was operated in an automatic mode and was traversed on a reciprocator while spraying from the top to bottom of the vertically placed mandrel. The partially fabricated devices consisting of a substrate, conductive layer and blocking layer were tape mounted and rotated on a cylindrical aluminum mandrel positioned on a shaft connected to a turntable. The generator layer dispersion was spray cycled in three passes with 1.5 minutes elapsing between passes. Finally, the coating was removed from the mandrel and was dried at 120° C. for 5 minutes in an air convection oven. The generator layer dry thickness was estimated to be between 0.4 and 2.0 micrometers in thickness.

Finally, the charge transport layer composition was formulated and sprayed. A one gallon amber glass bottle was charged with 88 grams N,N'bis-(3''-methylphenyl)-[1,1'-biphenyl]-4,4'diamine, 132 grams polycarbonate resin (Merlon M-39, available from Mobay Chemical Co., Inc.), 2640 grams of methylene chloride and 1760 grams of 1,1,2-trichloroethane. After roll milling the bottle for two days, the resulting solution was sampled for spray fabrication using the previously described spray equipment manufacture by Binks Manufacturing Co. The fluid pressure was 8 psi and the spray atomization pressure was 55 psi. The needle setting was at 0.75 turns and the spray fan angle at 0.5 turns counted from the closed position. The spray gun was operated in an automatic mode and was traversed on a reciprocator while spraying from the top to the bottom of the vertically placed mandrel. The partial devices with the last coated generator layer on the surface were tape mounted and rotated on a cylindrical aluminum mandrel position on a shaft connected to a turntable. The above transport layer solution was sprayed in five passes with 1.5 minutes elapsing between passes. Finally, the coating was removed from the mandrel and was dried at 120° C. for 10 minutes in an air convection oven. The transport layer dry thickness was found to be between 20–30 micrometers using the previously described Dektak® (Example II) procedure.

The above devices, totally sprayed except for the substrate and the two commercially available titanized Mylar substrate-conductive layer combinations, were charge-erase cycled for 200 cycles at ambient RH using the ambient scanner. The electrical cyclic results are indicated in the following table.

TABLE G

| Device No. | Conductive Layer | Polymer Blocking Layer | $V_{O(1)}$[c] | $V_{O(2-5)}$[d] | $V_{O(200)}$[e] | $V_{R(1)}$[f] | $V_{R(200)}$[f] |
|---|---|---|---|---|---|---|---|
| IIIe | Carboset 514A | P(4VPy)[a] | 700 | $360_4$ | 400 | 45 | 30 |
| IIIf | Carboset 514A | P(4VPy)[b] | 750 | $450_5$ | 500 | 45 | 70 |
| IIIg | Titanium | P(4VPy)[a] | 800 | $820_2$ | 720 | 35 | 50 |
| IIIh | Carboset 514A | P(2VPy)[a] | 660 | $550_2$ | 600 | 100 | 180 |
| IIIi | Carboset 514A | P(2VPy)[b] | 640 | $500_2$ | 560 | 70 | 140 |
| IIIj | Titanium | P(2VPy)[a] | 820 | $880_2$ | 920 | 80 | 225 |

[a]Blocking layer thickness close to 1.0 micrometer (1.0 ± 0.3).
[b]Blocking layer thickness close to 2.0 micrometers (2.0 ± 0.3).
[c]$V_{O(1)}$ is the initially measured surface voltage directly after corotron charging the device the first time.
[d]$V_{O(2-5)}$ is the measured surface voltage obtained after corotron charging and photodischarging the device for 1 or 2 or 3 or 4 cycles and charging for the 2nd, 3rd, 4th or 5th cycle, respectively.
[e]$V_{O(200)}$ is the surface voltage measured after corotron charging and photodischarging the device for 199 cycles and charging for the 200th cycle.
[f]$V_R$ is the residual voltage after corotron charging and photodischarging the device for the indicated number of cycles.

ps The P(VPy) blocking layers in these carbon black conductive layer devices have inferior blocking capability compared to other blocking layers containing water insoluble high molecular weight unmodified hydroxy methacrylate polymers alone (IIc & IId), the same hydroxy methacrylate ester polymers with P(4VPy) adhesive layers (IIa & IIb), and mixed P(VPy) isomers without hydroxy methacrylate polymers present (IIIa–IIId). The improved blocking capability (higher $V_o$ versus the same devices without a blocking layer in Example I) of the aforementioned three blocking layer compositions indicates these compositions are more effective in preventing conductive layer components from mixing upward into the generator and/or transport layers during coating of these layers. The solvent barrier properties of these compositions contribute significantly to blocking conductive layer mixing and its effect, i.e. decreased $V_O$ with cycling. P(4VPy) and P(2VPy) blocking layers alone (devices IIIe, IIIf, IIIh, IIIi) have insufficient solvent barrier properties to subsequently applied coating compositions which leads to $V_O$ charge depletion levels just above that found in the Example I devices (no blocking layers) having the same conductive layer. The rapid (2–5 cycles) $V_O$ cycle-down in the above devices (TABLE G) dictates the severity of the interlayer mixing and $V_O$ charge depletion. The absence of the possibility of conductive layer component mixing in the titanium conductive layer devices (IIIg & j) appears electrically as higher $V_{O(1)}$ with retention thereof with cycling. The presence of the natural titanium oxide blocking layer on this metallic conductive layer also contributes to the prevention of $V_O$ cycle-down. The absence of $V_O$ cycle-down in the titanium devices provides indirect evidence that carbon black conductive layers are deleteriously involved in causing $V_O$ cycle-down in otherwise identical devices.

The $V_R$ cycle-up in the device set of the above TABLE G occurs extensively in all the P(2VPy) blocking layers devices (IIIh–IIIj) independent of conductive layer composition. The most likely cause of $V_R$ cycle-up originates in the ease of P(2VPy) migration into the generator and/or transport layers during solvent coating of these layers. As a result, hole trapping occurs with $V_R$ cycle-up similar to that observed in drawbar coated devices (IIIa–IIId) which also contain P(2VPy). The absence of extensive $V_R$ cycle-up in the P(4VPy) blocking layer devices (IIIe–IIIg) may reflect a lesser degree of P(4VPy) migration into the upper (CGL, CTL) layers during coating thereof. In addition, the P(4VPy) is not as effective a hole trapping material as is the P(2VPy), so migrated P(4VPy) is less effective than migrated P(2VPy) in forming trap sites. The $V_R$ in IIIe–IIIg therefore cycles up much less. Since none of the devices in this Example delaminated during routine fabrication and electrical testing procedures, the interfacial adhesion at all interfaces is sufficient to enable photoreceptor use. Overall, the electrical cycling properties of the devices in this Example illustrate two important desirable properties of a photoreceptor blocking layer: (1) The blocking layer should co-function, as much as possible, as a barrier layer to subsequently applied coating compositions so that it becomes a protective coating for non-metallic conductive layers. (2) The blocking layer itself should be insoluble in subsequently applied coating compositions so that it can maintain barrier properties [as described in (1)] and so that the blocking layer material itself does not migrate into the CGL and CTL during coating thereof. The insolubility of the water insoluble high molecular weight unmodified hydroxy methacrylate polymer blocking layers of this application arises from dense intermolecular hydrogen bonding.

EXAMPLE IV

In this Example, the use of three different molecular weights of poly(2-hydroxyethylmethacrylate) P(HEMA) as a blocking layer on the conductive substrate, carbon impregnated Tedlar® (CIT), is illustrated. Polymers were obtained from three different sources and were characterized by intrinsic viscosity. Weight average molecular weight was determined only for the highest viscosity polymer using a standard light scattering method. The intrinsic viscosity [η] was measured in methanol solution at 25° C. by extrapolation to infinite dilution of reduced viscosities obtained at four different concentrations (% g/dl) 1.0, 0.67, 0.50 and 0.40. A trace of insoluble polymer was first filtered from the Polyscience sample but the other two samples were totally soluble in methanol. The data are summarized in the following table. The intrinsic viscosity average molecular weights (Mv) were generated from the intrinsic viscosity values [η] using the Mark-Houwink constants $K=1.25\times10^{-4}$ and alpha=0.62. The weight average molecular weight (Mw) range for the Polyscience and Synthesized samples were not measured, but were projected from the measured Mw of the Scientific Polymer Products sample resulting in the Mw values in Table H.

TABLE H

| Source of P(HEMA) | [η]dl/g | Mv | Mw |
|---|---|---|---|
| Scientific Polymer Products | 0.654 | $9.95\times10^5$ | $1.0\text{–}1.4\times10^6$ |
| Polyscience | 0.506 | $6.58\times10^5$ | $6.6\text{–}9.3\times10^5$ |
| Synthesized | 0.272 | $2.42\times10^5$ | $2.4\text{–}3.4\times10^5$ |

The glass transition temperature for the 0.654 intrinsic viscosity P(HEMA) was found to be 110° C. by DSC. This value decreases considerably, as a function of residual solvent and undefined thermal histories, in various P(HEMA) samples. Glass transition values for P(HEMA) have been reported in a temperature range of 55° C.–104° C. [L. R. Brostrom, D. L. Coleman, D. E. Gregonis and J. D. Andrade, *Makromol. Chem.*, Rapid Commun. 1, 341–343 (1980).]

NMR analysis ($C^{13}$) of the 0.654 intrinsic viscosity P(HEMA) in concentrated (7–8 weight percent) DMSO-$d_6$ solution between 297° K.–307° K. provided information concerning the tacticity of the polymer. The NMR spectrometer was a Bruker AM 360 equipped with a 5 mm QNP probe at a carbon frequency of 90.5 MHz. The $C_{13}$ spectrum was obtained using inverse grated decoupling with 30 seconds recycle delay between acquisitions to ensure quantitative integrals for all carbon nuclei. Monitoring the alpha-methyl carbon signal area indicated the following percent triad repeat unit content: 67 percent syndiotactic, 30 percent heterotactic and 3 percent isotactic. P(HEMA) tacticities were previously studied using $^{13}C$ NMR wherein P(HEMA) obtained from a radical solution polymerization had a similar triad distribution, i.e. 58 percent syndiotactic, 42 percent heterotactic <1 percent isotactic [D. E. Gregonis, G. A. Russell, J. D. Andrade and A. C. deVisser, *Polymer* 19, 1279–1284 (1978)]. Thus, the triad content for the 0.654 intrinsic viscosity P(HEMA) is typical of a radically polymerized polymer.

The low molecular weight P(HEMA) was prepared using a modification of the procedure described in a Czechoslovakian Patent [Chem. Abst. 99(2): 14003j (1982); Czech CS200433B, No. 30, 1982] wherein the solvent was changed from methyl Cellosolve to tertiary butylalcohol and the crosslinking agent was omitted. More specifically, to a 500 ml three neck round bottom flask, equipped with an air reflux condenser, an argon inlet and outlet, a heating mantle as heat source and a magnetic stirring football for magnetic stirring was charged 40 grams of Mhoromer BM-920 (available from Rohm Tech, Inc.) which is 2-hydroxyethylmethacrylate or HEMA monomer. The monomer was first passed three times through a De-Hibit 100 (Polysciences Inc.) ion exchange resin column (24"×1" diameter column) to remove the 200 ppm methylhydroquinone polymerization inhibitor. To the flask was also charged 240 grams of tertiary butylalcohol (99.5 percent purity, available from Aldrich Chemical) and 0.159 grams AIBN (Polysciences, Inc.) polymerization initiator, which is 0.3 mole percent based on the monomer charge. The solution was magnetically agitated and argon gas was passed through the solution throughout the polymerization period. The solution was heated at gentle reflux (79° C.) for 16 hours, was cooled to ambient temperature, and the viscous polymer solution was coagulated into 3.2 l of reagent grade toluene. The coagulated polymer was vacuum filtered on a coarse frit funnel and the filtered polymer was slurried at room temperature with 300 ml reagent grade tetrahydrofuran. The slurried polymer was filtered as before and dried overnight in a vacuum oven on a sheet of Mylar at 60° C. at 0.5 mm Hg. The dried water-white polymer yield was 31.25 g (78.1 percent of theory) and had an intrinsic viscosity of 0.272 dl/g. This material was used without further purification to drawbar coat blocking layers.

In the first electrical data set shown in TABLE J below, the low molecular weight P(HEMA) is compared to the high molecular weight P(HEMA), wherein the low molecular weight P(HEMA) has an intrinsic viscosity of [η]=0.272 and a weight average molecular weight of between about $2.4\times10^5$ and about $3.4\times10^5$ vs. the high molecular weight P(HEMA) which has an intrinsic viscosity of 0.506 dl/g and a weight average molecular weight of between about $6.6\times10^5$ and about $9.3\times10^5$. All devices were drawbar (0.5 mil gap) fabricated on the bulk conductive substrate, carbon impregnated Tedlar® (CIT). The blocking layer compositions were formulated as follows in TABLE I.

TABLE I

| Device No. | P(HEMA) Solids Level (Weight %) | P(HEMA) (Grams) | Solvent Type | Solvent Grams |
|---|---|---|---|---|
| IVa | 3.6 | 0.36 | methanol | 9.64 |
| IVb | 6.0 | 0.60 | methanol | 9.40 |
| IVc | 3.6 | 0.36 | t-butanol | 9.64 |
| IVd | 7.2 | 0.72 | t-butanol | 9.28 |

After drying the coated blocking layers at standard conditions (Example II), devices IVc and IVd were further coated with a 0.6 weight percent solution of P(4VPy) as described in Examples I and II. Charge generator and transport layers were formulated, coated and dried as described in Example I. The devices were electrically charge-erase evaluated at ambient RH (≧12 percent) and low RH (<5%) as indicated in the following table.

TABLE J

| Device No. | P(HEMA) [η] (dl/g) | Blocking Layer Thickness (micrometer) | % RH | $V_{O(1)}$ | $V_{O(200)}$ | $V_{R(1)}$ | $V_{R(200)}$ |
|---|---|---|---|---|---|---|---|
| IVa[a] | 0.272 | 0.5–0.7 | 12 | 910 | 800 | 25 | 32 |

TABLE J-continued

| Device No. | P(HEMA) [η] (dl/g) | Blocking Layer Thickness (micrometer) | % RH | $V_{O(1)}$ | $V_{O(200)}$ | $V_{R(1)}$ | $V_{R(200)}$ |
|---|---|---|---|---|---|---|---|
| IVb[a] | 0.272 | 0.8–1.0 | 12 | 890 | 870 | 28 | 57 |
| IVc[b] | 0.506 | 0.5–0.7 | 29 | 1400 | 1420 | 45 | 50 |
| IVc[b] | 0.506 | 0.5–0.7 | <5 | 1340 | 1360 | 60 | 80 |
| IVd[b] | 0.506 | 1.0–1.2 | 29 | 1380 | 1410 | 40 | 50 |
| IVd[b] | 0.506 | 1.0–1.2 | <5 | 1320 | 1360 | 55 | 75 |

[a]Data obtained on the ambient cyclic scanner.
[b]Data obtained on the environmental cyclic scanner.

The $V_{O(1)}$ data and $V_{O(200)}$ data indicate surface charge retention thereby showing that both P(HEMA) samples block hole injection in the thickness range 0.5 to 1.2 micrometers and in the RH range <5–29 percent. The very low humidities (<5% RH) cause a slight increase in $V_r$ and $V_r$ cycle-up in 200 cycles. The presence of the 4-PVPy adhesive layer seems to have little effect on cyclic electrical properties. The devices in Table J are defined by an intrinsic viscosity value wherein 0.272 dl/g is the low molecular weight P(HEMA) and the 0.506 dl/g is the high molecular weight P(HEMA).

In the second set of charge-erase electrical data in TABLE K below, high molecular weight ([η]=0.654 dl/g) P(HEMA) having a weight average molecular weight of about 1,000,000–1,400,000 was evaluated as a drawbar fabricated blocking layer on the same bulk conductive substrate, carbon impregnated Tedlar (CIT). P(HEMA) methanol solutions of 1.8, 3.6, 6.0 and 14.4 weight percent were formulated, coated and dried as described in the first data of this Example. When a P(4VPy) adhesive layer was used, it was formulated, coated and dried as described in Examples I and II for the 0.6 weight percent coating solution. Charge generator and charge transport layers were formulated, coated and dried as described in Example I. The devices were evaluated at ambient (27%) and low (<5%) relative humidities using the ambient cyclic scanner. The presence or absence of a 0.06 micrometer P(4VPy) adhesive layer (thickness projected as described in Example II) in the following table is noted with a yes or no. Blocking layer thickness were obtained from the Dektak generated calibration curve in Example II.

this 4000 cycle test at both low and ambient RH. However, depending upon the specific conductive layer composition employed, blocking layer thicknesses of greater than about 2 micrometers may be too thick to enable complete photodischarge ($V_R$ cycle-up) at ambient or low RH in the presence or absence of an adhesive layer. The presence of an adhesive layer on a blocking layer in the 0.2–1.0 micrometer thickness range is electrically negligible except at 1.0 micrometer where a significant $V_R$ cycle-up at low RH (35 to 70 volts) occurred in 4,000 cycles. Thus, when using the P(4VPy) adhesive layer, blocking layer thickness of 0.2–0.7 micrometer are favored in that the $V_R$ increase at low RH is considerably less. Thus, all three of the above P(HEMA) samples provide useful hole blocking capacity on chemically inert CIT conductive layers.

EXAMPLE V

Illustrated in this Example is the use of two different molecular weights of P(HEMA) as blocking layers on a conductive polypyrrole based polymer (ICP-117 from Polaroid Corp.). The conductive polymer dispersion was formulated, drawbar coated and dried as described in Example I on either insulative polymer substrates, Mylar or Tedlar®. The P(HEMA) blocking layer solutions were prepared with three coating solvents using a 0.5 mil bar gap unless otherwise indicated. Thicknesses for methanol and Dowanol PM coated P(HEMA) blocking layers were projected from the dry thickness/concentration curve described in Example II for P(HPMA). For t-butanol coated P(HEMA) blocking layers, a 2 weight percent solution was coated since

TABLE K

| Device No. | P(4VPy) | Blocking Layer (micrometer) | % RH | $V_{O(1)}$ | $V_{O(20)}$ | $V_{O(200)}$ | $V_{O(\sim 4K)}$ | $V_{R(1)}$ | $V_{R(20)}$ | $V_{R(200)}$ | $V_{R(\sim 4K)}$ |
|---|---|---|---|---|---|---|---|---|---|---|---|
| IVe | No | 0.2–0.4 | 27 | 920 | 860 | 800 | 800 | 22 | 20 | 20 | 25 |
| IVe | No | 0.2–0.4 | <5 | 840 | 800 | 800 | 800 | 30 | 35 | 35 | 35 |
| IVf | Yes | 0.2–0.4 | 27 | 1030 | 980 | 960 | 960 | 32 | 30 | 30 | 40 |
| IVf | Yes | 0.2–0.4 | <5 | 900 | 760 | 760 | 760 | 45 | 50 | 50 | 50 |
| IVg | No | 0.5–0.7 | 27 | 880 | 900 | 880 | 920 | 25 | 25 | 25 | 30 |
| IVg | No | 0.5–0.7 | <5 | 840 | 860 | 860 | 880 | 37 | 65 | 65 | 55 |
| IVl | Yes | 0.5–0.7 | 27 | 1000 | 980 | 980 | 1000 | 25 | 25 | 25 | 27 |
| IVl | Yes | 0.5–0.7 | <5 | 920 | 980 | 980 | 940 | 37 | 57 | 57 | 45 |
| IVm | No | 0.8–1.0 | 27 | 940 | 960 | 960 | 980 | 25 | 25 | 20 | 20 |
| IVm | No | 0.8–1.0 | <5 | 940 | 1000 | 1000 | 1020 | 30 | 40 | 50 | 50 |
| IVn | Yes | 0.8–1.0 | 27 | 940 | 1000 | 1020 | 1050 | 25 | 30 | 25 | 22 |
| IVn | Yes | 0.8–1.0 | <5 | 960 | 1050 | 1050 | 1050 | 35 | 75 | 80 | 70 |
| IVo | No | 2.0–2.4 | 27 | 800 | 880 | 880 | 800 | 75 | 90 | 95 | 115 |
| IVo | No | 2.0–2.4 | <5 | 840 | 1050 | 1070 | 950 | 100 | 180 | 210 | 200 |
| IVp | Yes | 2.0–2.4 | 27 | 800 | 960 | 960 | 1020 | 180 | 220 | 230 | 320 |
| IVp | Yes | 2.0–2.4 | <5 | 860 | 1100 | 1100 | 1020 | 205 | 270 | 300 | 280 |

All devices, in the Table K immediately above, adequately prevented hole injection as evidenced by high $V_{O(1)}$ and retention thereof out to $V_{O(4K)}$. In the blocking layer thickness range of 0.2 to 1.0 micrometer, generally acceptable $V_R$ and $V_R$ cycle-up were observed in the highest molecular weight P(HEMA) failed to dissolve in this particular solvent at higher concentrations at ambient temperature. Larger drawbar gaps were used in an attempt to increase the blocking layer thickness which was estimated at 0.2–0.4 micrometer for P(HEMA) blocking layers coated from t-butanol. Standard drying conditions (Example II) were employed for all the P(HEMA) blocking layer compositions irrespective of coating solvent. The P(HEMA) blocking layer compositions in methanol or Dowanol PM were formulated at 3.6 and 6.0 weight percent to give projected dry thickness of 0.5 to 0.7 and 0.8 to 1.0 micrometer, respectively. Since no P(4VPy) adhesive layers were used, the charge generator and transport layers were next formulated, drawbar coated and dried as described in Example I. All charge-erase cycling data were obtained at ambient RH (12–29 percent) using the cyclic scanners indicated in the following TABLE L.

TABLE L

| Device No. | [η] | P(HEMA) Blocking Layer Solvent | Thickness (μm) | % RH | $V_{O(1)}$ | $V_{O(200)}$ | $V_{R(1)}$ | $V_{R(200)}$ |
|---|---|---|---|---|---|---|---|---|
| Va | 0.272 | Methanol | 0.5–0.7 | 12 | 400 | 380 | 18 | 48 |
| Vb | 0.272 | Methanol | 0.8–1.0 | 12 | 380 | 340 | 15 | 25 |
| Vc | 0.654 | Methanol | 0.5–0.7 | 16 | 600 | 560 | 29 | 82 |
| Vc | 0.654 | Methanol | 0.5–0.7 | 29 | 630 | 650[a] | 55 | 205[a] |
| Vd | 0.654 | Methanol | 0.8–1.0 | 16 | 770 | 780 | 20 | 20 |
| Vd | 0.654 | Methanol | 0.8–1.0 | 29 | 780 | 790[a] | 20 | 45[a] |
| Ve | 0.654 | t-Butanol | 0.2–0.4[b] | 15 | 400 | 410 | 26 | 50 |
| Vf | 0.654 | t-Butanol | 0.2–0.4[c] | 15 | 440 | 460 | 26 | 55 |
| Vg[d] | 0.654 | Dowanol PM | 0.8–1.0 | 21 | 805 | 860 | 30 | 50 |
| Vh[d] | 0.654 | Dowanol PM | 0.5–0.7 | 21 | 385 | 450 | 40 | 105 |

[a]3,500 continuous cycles.
[b]2 weight percent solution using a 1 mil bar gap.
[c]2 weight percent solution using a 1.5 mil bar gap.
[d]Environmental cyclic scanner used for this device and the ambient cyclic scanner used for the other devices in the table.

Inspection of the above charge-erase cycling data reveals several facts pertinent to the P(HEMA) molecular weight and blocking layer thickness when applied over the ICP-117 conductive layers. The lower molecular weight P(HEMA) blocking layers, Va and Vb, at both thicknesses were ineffective in obtaining high $V_O$ values desirable in xerographic photoreceptors. Because lower molecular weight P(HEMA) is a poorer solvent barrier, the solvent used in coating the CGL and CTL readily mixed with the conductive layer components causing them to migrate upwards into the CGL and/or the CTL. Once out of their intended location, migrated conductive layer components deplete charging and give rise to the low $V_O$ (devices Va and Vb). Devices (Vd and Vg) containing 0.8–1.0 micrometer of high molecular weight P(HEMA) blocking layers afford xerographically useful high $V_O$ values confirming the strong solvent barrier properties attributable to high molecular weight P(HEMA). However, as the thickness of the high molecular weight P(HEMA) was reduced to 0.5–0.7 micrometer in devices Vc and Vh, $V_O$ values decreased indicating even the high molecular weight P(HEMA) blocking layer, when less than about 0.8 micrometer, is not as strong a solvent barrier on ICP-177 conductive layers as compared to its effectiveness as a barrier on chemically inert CIT conductive layers. This conductive layer composition has an aggressive affinity for subsequently used organic coating solvents. This implies that a very low level of organic solvent penetration through the high molecular weight P(HEMA) blocking layer is sufficient to generate extensive mixing and upward migration of charge depleting conductive layer components. In contrast, as little as 0.2 micrometer of high molecular weight P(HEMA) was sufficient to achieve and retain high $V_O$ values in 4,000 cycles when coated on the solvent inert bulk conductive substrate, carbon impregnated Tedlar® (CIT) (devices IVe and f in Example IV). Thus, the more solvent inert a conductive layer is, the less stringent are the solvent barrier requirements of the blocking layer, thus enabling the use of thinner blocking layers. There appears to be no blocking layer coating solvent effect on electrical properties when sufficiently thick (0.8–1.0 micrometer) blocking layers are coated. This suggests both coating solvent, Dowanol PM and methanol are effectively removed in convection oven drying, and also that the two solvents do not alter the intermolecular H-bonding density by altering the bulk morphology of the P(HEMA). Since only thin blocking layers could be coated from the t-butanol/P(HEMA) solutions, any solvent effect on electrical properties will be masked by the already discussed conductive layer mixing problem.

The $V_R$ cycle-up in devices Vc and Vh implies a charge trapping mechanism is simultaneously operative with the charge depletion mechanism. The precise cause of the trapping mechanism is unclear, but it is possible that some of the P(HEMA) is moved up into the CGL and/or CTL during coating thereof. As conductive layer components migrate up through the P(HEMA) blocking layer into the CGL and CTL, some of the P(HEMA) may be uprooted and carried along into these layers resulting in charge trapping and the observed $V_R$ cycle-up.

EXAMPLE VI

In this Example, a head to head comparison was made between P(HPMA) and P(HEMA) blocking layers of the same thickness (0.8–1.0 micrometer) at ambient and low RH charge-erase cycling conditions. The conductive layers were prepared from a carbon black dispersed in an olefinic primer (LE16610O) available from the Red Spot Paint & Varnish Co. The LE1661O conductive layer on Tedlar® was formulated, sprayed and dried as described in Example I. The P(HPMA) is a low molecular weight polymer obtained from Polysciences, Inc. having a weight average molecular weight of less than 400,000. The P(HEMA) [η]=0.506 was also obtained from Polysciences, Inc. and has a weight average molecular weight of between about $6.6\times10^5$ and about $9.3\times10^5$. The P(HEMA) blocking layer was drawbar coated (0.5 mil gap) onto the sprayed conductive layers using 6 weight percent solutions in t-butanol. The medium viscosity P(HEMA), unlike the high viscosity P(HEMA), dissolved in t-butanol at 6 weight percent. After applying standard drying conditions to the blocking layer, P(4VPy) adhesive layer compositions were formulated, coated and dried as previously described in this Example. Both blocking and adhesive layer thicknesses were estimated from the previously described dry thickness concentration curve (Example II). Charge generator and transport layers were formulated, coated and dried as described in Example I. The devices were tested with the ambient cyclic scanner for 200 cycles.

TABLE M

| Device No. | Blocking Layer Composition | % RH | $V_{O(1)}$ | $V_{O(200)}$ | $V_{R(1)}$ | $V_{R(200)}$ |
|---|---|---|---|---|---|---|
| VIa | P(HPMA) | 58 | 1220 | 1420 | 35 | 60 |
| VIa | P(HPMA) | <5 | 1440 | 1510 | 60 | 190 |
| VIb | P(HEMA) | 35 | 900 | 900 | 40 | 50 |
| VIb | P(HEMA) | <5 | 880 | 940 | 35 | 50 |

In this device set, both P(HPMA) and P(HEMA) provide satisfactory hole blocking capability in 200 cycles at both ambient and low RH. $V_O$ remains significantly higher than in the same device in Example I without a blocking layer. However, the P(HPMA) blocking layer device develops considerable $V_R$ cycle-up at low RH testing conditions. This $V_R$ cycle-up is probably not related to interlayer mixing because it did not occur at ambient RH when the same device was tested. More likely, the $V_R$ cycle-up is probably related to a decreased trapped water content in the low molecular weight P(HPMA) versus the high molecular weight P(HEMA) blocking layers. More trapped water, in high molecular weight P(HEMA) versus low molecular weight P(HPMA) assists in enhancing the hydrogen bonding density by bridging hydrophobic (low H-bonding density areas) gaps. Presumably, the combination of more water and denser H-bonding in high molecular weight P(HEMA) creates less resistive pathways for the transport of photodischarged electrons through these relatively thick blocking layers without significant electron trapping. Thus, $V_R$ remains low at low RH in devices containing high molecular weight P(HEMA) blocking layers.

EXAMPLE VII

This Example illustrates the use of P(HEMA) blocking layers at two different molecular weights and three different thicknesses. The blocking layers were drawbar coated on LE1661O carbon black conductive layers which were formulated and sprayed (on Tedlar ® substrates) and dried as described in Example I. In addition, three of the high molecular weight P(HEMA) devices were crosslinked with glutaraldehyde, added as a 25 weight percent aqueous solution just prior to drawbar coating the blocking layers. Crosslinking then proceeded after solvent evaporation during air convection oven drying of the coating at 120° C. for one hour. The charged molar ratio of glutaraldehyde to P(HEMA) repeat units in the blocking layer coating solution was held constant at 1:3. Each aldehyde group in the glutaraldehyde molecule is capable of crosslinking two P(HEMA) hydroxyl groups through formation of acetal linkages. The simultaneous elimination of water at 120° C. drives the crosslinking reaction in the absence of acidic catalysis. Crosslinking was confirmed to have occurred at the above stoichiometry and curing conditions in a separate experiment in which the crosslinked coating, which as scraped from a glass slide, was totally insoluble in Dowanol PM. The P(HEMA) blocking layers were formulated at 3.6 and 6.0 weight percent in methanol and Dowanol PM, and at 2 weight percent in t-butanol. The P(HEMA) viscosities, indicated in the following Table N, fall into the weight average molecular weight ranges described in Example IV. Standard drying conditions were used when crosslinking agent was not added. Since no poly(4-vinylpyridine) adhesive layer was coated in these devices, charge generator and charge transport layers were applied as described in Example I. The devices were charge erase cycled for 200 cycles at ambient RH (12–21 percent) using the indicated cyclic scanners.

TABLE N

| Device No. | [η] | P(HEMA) Blocking Layer Thickness (μm) | Solvent | $V_{O(1)}$ | $V_{O(200)}$ | $V_{R(1)}$ | $V_{R(200)}$ |
|---|---|---|---|---|---|---|---|
| VIIa | 0.272 | 0.5–0.7 | Methanol | 310 | 310 | 36 | 86 |
| VIIb | 0.272 | 0.8–1.0 | Methanol | 370 | 320 | 36 | 50 |
| VIIc[c] | 0.654 (X-linked) | 0.5–0.7 | Methanol | 695 | 640 | 40 | 65 |
| VIId | 0.654 | 0.5–0.7 | Methanol | 540 | 560 | 40 | 104 |
| VIIe[c] | 0.654 (X-linked) | 0.8–1.0 | Methanol | 885 | 885 | 35 | 35 |
| VIIf | 0.654 | 0.8–1.0 | Methanol | 800 | 920 | 52 | 80 |
| VIIg[c] | 0.654 (X-linked) | 0.5–0.7 | Dow PM | 840 | 1000 | 30 | 75 |
| VIIh | 0.654 | 0.5–0.7 | Dow PM | 880 | 1040 | 90 | 200 |
| VIIi | 0.654 | 0.8–1.0 | Dow PM | 830 | 970 | 76 | 85 |
| VIIj | 0.654 | 0.2–0.4[a] | t-Butanol | 600 | 380 | 40 | 44 |
| VIIk | 0.654 | 0.2–0.4[b] | t-Butanol | 720 | 500 | 50 | 3 |

[a]2 weight percent solution using a 1.0 mil bar gap
[b]2 weight percent solution using a 1.5 mil bar gap
[c]environmental cyclic scanner used; all other devices tested on the ambient cyclic scanner.

The low intrinsic viscosity [η] low molecular weight P(HEMA) is clearly inferior to the high viscosity high molecular weight material at both thicknesses. The electrical results obtained for the low molecular weight P(HEMA) blocking layers in this device formed on LE 16610 conductive layers were very similar to those obtained on polypyrrole conductive layers, all other layers being equal (compare devices Va and Vb with VIIa and VIIb). The charge depletion (low $V_O$) mechanism due to interlayer mixing effects discussed in Example V also applies here. In this Example, the evidence for interlayer mixing is more compelling. In devices VIIa and VIIb, the $V_O$ values are less than $V_O$ for the same device without a blocking layer (Example I). This result requires that the generator and/or transport layers have become more dark conductive, and provides strong evidence that an electrically significant quantity of conductive material from the LE1661O conductive layer has migrated and mixed into the upper two layers during coating thereof.

The impact of glutaraldehyde crosslinking is most noticeable in the thinner (0.5–0.7 vs. 0.8–1.0 micrometer) blocking layer devices when high molecular weight P(HEMA) is used as the hole blocking polymer. The crosslinked device VIIc charges 155 volts higher than its sister device (VIId) which has not been crosslinked. The crosslinked P(HEMA) blocking layer is better able to function as a barrier layer and so more effectively blocks upward migration and mixing of LE1661O conductive layer components into the generator and transport layers during coating thereof. In addition, crosslinking the P(HEMA) blocking layer reduces $V_R$ cycle-up because hole trapping P(HEMA) remains fixed in place in the crosslinked blocking layer. Thus, the P(HEMA) cannot be carried upwards by migrating conductive materials because the crosslinked P(HEMA) layer itself significantly decreases the extent of conductive material migration which is the primary cause of trapping and $V_R$ cycle-up. When the high molecular weight P(HEMA) blocking layer thickness is increased to 0.8–1.0 micrometer, electrical effects due to crosslinking (VIIe vs VIIf or VIIi) become indiscernable. The increased P(HEMA) blocking layer thickness alone is sufficient to impart solvent resistance and barrier (to mixing) properties making P(HEMA) crosslinking unnecessary in thicker blocking layers.

Devices which contain uncrosslinked high molecular weight P(HEMA) blocking layers of 0.5–0.7 micrometer thickness (VIId and VIIh) differ significantly in $V_R$ cycle-up. The larger $V_R$ cycle-up for VIIh versus VIId implies that the change in blocking layer coating solvent to the more organic Dowanol PM (from methanol) is at least, in part, responsible for the trapping and $V_R$ cycle-up. Apparently, the propylene glycol methyl ether (Dowanol PM) solvent is more effective than methanol in penetrating and uprooting LE1661O conductive layer components. This solvent induced conductive layer component migration into the blocking layer disrupts and decreases the hydroxyl-hydroxyl hydrogen bonding density in the blocking layer. Consequently more electron trap sites are generated in the lower density hydroxyl-hydroxyl H-bonding areas and this results in the larger $V_R$ cycle-up. Fortunately, in thicker uncrosslinked high molecular weight P(HEMA) blocking layer devices (VIIf and VIIi), the magnitude of this mixing phenomenon (and the resulting $V_R$ cycle-up) is insufficient irrespective of which blocking layer coating solvent is used.

Identical devices VIId and VIIh differ markedly in $V_O$ (by 340 volts). Since the only formulation variation in the two devices is the change in blocking layer coating solvents, this change must in part be responsible for the $V_O$ decrease. The lower boiling methanol cast coatings apparently loose their solvent too rapidly so that thin and thick areas arise because of insufficient polymer flow. The thin areas of such a non-uniform blocking layer become prime sites for hole injection from the conductive layer. However, blocking layer thinness is not a sufficient explanation for low $V_O$ since 0.2 micrometer methanol cast P(HEMA) blocking layers are sufficiently thick to block hole injection (Example IV) on carbon impregnated Tedlar® bulk conductive substrates. The combination of a thin blocking layer area superimposed on/or around a conductive layer vertical protrusion (both layers being non-uniform in thickness) provides the most complete physical picture of interfacial sites contributing to $V_O$ decline. Thus, the blocking layer-conductive layer formulation interdependency strongly controls $V_O$ & $V_R$, except when thicker high molecular weight P(HEMA) blocking layers are used (devices VIIf and VIIi). Then the coating solvent effect on $V_O$ disappears because now even the non-uniform thin areas in the methanol coated blocking layers are sufficiently thick to block hole injection from the LE16610 conductive layer. Thus, the use of thick P(HEMA) coatings as blocking layers eliminates considerably the deleterious impact of non-uniform coating thicknesses on charge-erase electrical properties.

The low charging levels exhibited by t-butanol coated P(HEMA) blocking layers simply indicates the presence of an overall thinner blocking layer which must exist because of the high molecular weight P(HEMA) solubility limitation (2 weight percent) in t-butanol, as described in Example V. Thus, the significantly thinner t-butanol coated P(HEMA) blocking layer, even if uniform in thickness, is porous to charge injection from the LE16610 conductive layer.

EXAMPLE VIII

This Example illustrates the use of both P(HEMA) and P(HPMA) blocking layers of various thicknesses on strongly injecting binderless cuprous iodide conductive layer. The conductive layers for all the devices in this Example were drawbar coated as described in Example I on Tedlar® substrates. The low molecular weight (less than 400,000 Mw) P(HPMA), available from Polysciences, was coated (0.5 mil drawbar gap) from 3.6 and 6.0 weight percent solutions in 90/10 by weight isobutanol/isopropanol to give the thicknesses in the following table. The moderate viscosity high molecular weight P(HEMA) $[\eta]=0.506$ was coated from 6 and 10 weight percent methanol solutions using 0.5 and 5.0 mil drawbar gaps to give 0.8–1.0 and 8.5 micrometer blocking layers, respectively. The very thick P(HEMA) blocking layer was measured directly with the Dektak® stylus whereas the other thicknesses were estimated from the dry thickness-concentration curve developed for P(HPMA) as described in Example II. A nominally thin (0.4–0.6 weight percent ~0.06 micrometer) P(4VPy) adhesive layer was drawbar coated (0.5 mil bar gap) and dried as described in previous examples. The charge generator and transport layers were next applied as described in Example I. The devices were cycled using the ambient cyclic scanner for either 1,450 or 12,000 cycles at ambient RH.

TABLE O

| Device No. | Blocking Layer Composition | Blocking Layer Thickness (micrometers) | X-Cycles | $V_{O(1)}$ | $V_{O(X)}$ | $V_{R(1)}$ | $V_{R(X)}$ |
|---|---|---|---|---|---|---|---|
| VIIIa | P(HPMA) | 0.5–0.7 | 1,450 | 730 | 680 | 35 | 25 |
| VIIIb | P(HPMA) | 0.8–1.0 | 1,450 | 680 | 640 | 30 | 24 |
| VIIIc | P(HEMA) | 0.8–1.0 | 12,000 | 1,200 | 1,000 | 20 | 58 |
| VIIId | P(HEMA) | ~8.5 | 12,000 | 1,200 | 1,400 | 24 | 174 |

Both the P(HPMA) and P(HEMA) blocking layers contribute electrically significant hole blocking capability, but the high molecular weight P(HEMA) enables much higher $V_O$ levels indicating that the high molecular weight P(HEMA) is more efficient at the same thickness in decreasing hole injection by the cuprous iodide conductive layer. The same cuprous iodide conductive layer device, without a blocking layer in Example I, charges to only 90 volts. The very thick high molecular weight P(HEMA) blocking layer device VIIId has a nominally low $V_R$ at cycling onset and cycles up to only 174 volts in 12,000 cycles. This relatively small $V_R$ cycle-up level observed for the 8.5 micrometer P(HEMA) blocking layer device implies that the natural abundance of electron trapping sites in high molecular weight P(HEMA) is small, and that the P(HEMA) is less likely to migrate into the CGL and CTL where hole trapping can occur. The lower migration aptitude of high molecular weight P(HEMA) versus other low molecular weight (Mw less than 400,000) hole blocking layer polymers emerges from P(HEMA) insolubility in commonly used organic coating solvents such as methylene chloride, tetrahydrofuran and toluene and also from its high molecular weight. The quantity of electron trapping sites in these blocking layers is very likely related to the quantity of disrupted hydrogen bonding density areas (hydrophobic areas) and/or to different levels of dielectric breakdown during xerographic discharge. High molecular weight unmodified hydroxy methacrylate polymers will trap and retain water at low RH thereby reducing the level of electron tripping sites and/or low hydrogen bonding density areas.

Blocking layers containing high molecular weight P(HEMA) (high viscosity $[\eta]=0.654$) were also charge-erase evaluated on strongly injecting conductive layers prepared as previously described in this Example. The P(HEMA) blocking layers were coated using standard 3.6, 6.0 and 2.0 weight percent solutions in Dowanol PM and t-butanol as indicated in the following table. In addition, two devices contained blocking layers which contained glutaraldehyde crosslinked P(HEMA) in which the mole ratio of P(HEMA) repeat units to moles of glutaraldehyde was about 3:1. Since no adhesive layer was applied in these devices, the charge generator and transport layers were next applied as described in Example I.

TABLE P

| Device No. | P(HEMA) Blocking Layer Thickness (micrometers) | Solvent | $V_{O(1)}$ | $V_{O(200)}$ | $V_{R(1)}$ | $V_{R(200)}$ |
|---|---|---|---|---|---|---|
| VIIIe[d] | 0.5–0.7 | Dow PM | 1040 | 1130 | 15 | 28 |
| VIIIf[d] | 0.2–0.4 | t-butanol | 1020 | 1020 | 18 | 38 |
| VIIIg[d] | 0.2–0.4 | t-butanol[c] | 1015 | 1010 | 16 | 22 |
| VIIIh[a,e] | 0.2–0.4 | t-butanol[c] | 870 | 870 | 25 | 25 |
| VIIIi[b,e] | 0.8–1.0 | Dow PM | 920 | 920 | 25 | 25 |

[a]0.2 g P(HEMA), 9.8 g tertiary butyl alcohol and 0.21 g of 25 weight percent aqueous glutaraldehyde dried at 120° C. for one hour.
[b]0.6 g P(HEMA), 9.4 g Dowanol PM and 0.62 g of 25 weight percent aqueous glutaraldehyde dried at 120° C. for one hour.
[c]A 1 mil bar gap used instead of the usual 0.5 mil bar gap.
[d]The ambient cyclic scanner was used.
[e]The environmental cyclic scanner was used.

Clearly all of the above devices charged well and retained their charging level in 200 cycles when compared to the 90 volt charging level obtained for the same cuprous iodide device having no blocking layer (Example I). Even the thin, 0.2–0.4 micrometer, high molecular weight P(HEMA) blocking layers prevented electrically deleterious charge injection affording devices with xerographically useful electrical properties. Crosslinking the P(HEMA) blocking layers did not improve cycling properties. The fact that such thin high molecular weight P(HEMA) blocking layers block hole injection on the strongly injecting conductive layers implies that the thin conductive layers have very small vertical protrusions, if any. That conductive layers should have a small thickness variation is reasonable since these conductive layers are very thin (200–1000 Angstroms). The absence of $V_R$ cycle-up in the above devices verifies the incompatibility between inorganic and the organic coating compositions subsequently applied. Thus, conductive layer mixing and migration is electrically insignificant.

EXAMPLE IX

This example illustrates the use of high molecular weight P(HEMA) ($\eta=0.654$) as a hole injection blocking layer on titanium coated Mylar (combination of conductive layer and substrate). A P(HEMA) blocking layer, a Se particles dispersed in poly (vinylbutyral) [PVB] CGL, and an N,N'-bis-(3''-methylphenyl)-[1,1'-biphenyl]-4,4'-diamine in polycarbonate (Merlon 50, available from Mobay Chemical Co.) CTL were all sprayed on top of the conductive titanium coated substrate. No adhesive layers were employed at the blocking layer—CGL interface. The spray fabrication of each layer will first be described starting with the P(HEMA) blocking layer.

A 2 weight percent high molecular weight P(HEMA) blocking layer solution was prepared by dissolving 12 grams of P(HEMA) in 588 grams of propylene glycol methyl ether (Dowanol PM, available from Dow Chemical Co.) solvent at room temperature. This solution was sprayed using commercially available spray guns and equipment manufactured by Binks Manufacturing Company. A Model 77 electrostatic spray gun was used in the non-electrostatic mode with a horizontal reciprocator. The Model 77 gun was equipped with a N63A fluid nozzle and a N63PC air atomization nozzle. The fluid pressure was 2.2 psi and the spray atomization pressure was 30 psi. With the atomization pressure at 30 psi and the fan angle at 0°, the fan angle air supply was opened until a reading of 170 cu. ft. per hour was obtained on the air flow meter in the atomization line. The spray gun was operated automatically and was traversed (3.8 ft./min.) on the reciprocator while spraying from right to left onto the horizontally positioned mandrel. The conductive substrate (titanium coated Mylar from E. I. duPont de Nemours & Co.) sheets to be sprayed were tape mounted onto the cylindrical aluminum mandrel which was rotated at a speed of 120 rpm. The P(HEMA) blocking layer was sprayed in one pass and the solvent moist coating was rotated for 3 or 4 minutes after completing the spray process in order to flash off the bulk of the solvent. The partially dried coating was dismounted from the mandrel and dried at 110° C. for 20 minutes in an air convection oven. The dry thickness of this P(HEMA) blocking layer was approximately 0.8–1.0 micrometer determined from the weight applied to a known area.

The generator layer (CGL) dispersion was prepared by roll milling trigonal selenium (13.6 grams), poly (vinylbutyral) [B-76, available from Monsanto] (3.5 grams) and the solvent mixture comprising 72.2 grams toluene and 24.2 grams tetrahydrofuran for several days (2–5 days). This concentrated dispersion (15 weight percent solids) contained approximately 45 volume percent trigonal selenium and 55 volume percent poly (vinylbutyral). Prior to spraying, the concentrated dispersion was diluted with a 1:1 (by weight) mixture of toluene and THF (141.8 grams each) which was manually swirled for 1–2 minutes to give a sprayable 4.3 weight percent total solids dispersion.

The above dispersion was sprayed using commercially available spray guns and equipment manufactured by Binks Manufacturing Company. A Model 21 non-electrostatic spray gun was used with a horizontal reciprocator. The Model 21 gun was equipped with a 63A fluid nozzle and a 63PE air atomization nozzle. The fluid pressure was 5 psi with the needle valve in the fluid nozzle set at 0.75 turns from the closed position. The spray atomization pressure was set as follows. With the fan angle closed to 0° and the air supply at 270 cu. ft./hour, the fan angle air supply was opened until a reading of 310 cu. ft/hour was obtained on the air flow meter in the atomization line. The spray gun was operated automatically and was traversed (3.7 ft./min.) on the reciprocator while spraying from right to left on the horizontally placed mandrel. The partial device sheets, consisting of Mylar substrate, titanium conductive layer and P(HEMA) blocking layer, were tape mounted onto the cylindrical aluminum mandrel which was rotated at a speed of 150 rpm during the spraying application. This selenium-PVB generator layer was sprayed in one pass and the partial device containing the solvent moist generator layer was dismounted from the mandrel and dried at 135° C. for 20 minutes in an air convection oven. The dry thickness of this selenium-PVB generator layer was approximately 0.26 micrometer determined from the weight applied to a known area.

The transport layer (CTL) solution was formulated at 5 weight percent solids as follows. Polycarbonate (Merlon M-50) (36 grams) was roll milled with 1140 grams of a solvent mixture comprising 684 grams methylene chloride and 456 grams 1,1,2-trichloroethane for 2–3 days until a solution formed. To this solution was added 24 grams of N,N'-bis-(3''-methylphenyl)-[1,1'-biphenyl]-4,4'-diamine and the mixture was further roll milled overnight to give a sprayable 5 weight percent solution comprising 40 weight percent N,N'-bis-(3''-methylphenyl)-[1,1'-biphenyl]-4,4'-diamine and 60 weight percent Merlon M-50 solids content.

The above CTL solution was spray fabricated onto the dried CGL again using the spray guns and associated equipment available from Binks. A Model 77 spray gun was again used in the non-electrostatic mode in the same Binks spray booth using the same horizontal reciprocator. The Model 77 spray gun was equipped with a 0.035 fluid nozzle and a N65PB air atomization nozzle. The fluid pressure was 8.4 psi and the spray atomization pressure was 60 psi. With the atomization pressure at 60 psi and the fan angle at 0°, the fan angle air supply was opened until a reading of 190 cu. ft./hour was obtained on the air flow meter in the air atomization line. The spray gun was operated automatically in a continuous mode and was traversed (3.9 ft./min.) on the reciprocator while spraying four passes (right to left and then left to right—2×) onto the horizontally placed mandrel. The partially completed device sheets to be sprayed were tape mounted onto the cylindrically shaped mandrel which was rotated at a speed of 100 rpm. After completion of the four pass CTL spray application, the solvent moist CTL coating was spun for an additional 3–4 minutes to flash off most of the solvent such that the thick CTL coating did not gravity sag when the mandrel was stopped from spinning. The partially dried coating was dismounted from the mandrel and was dried in an air convection oven by slowly increasing the temperature of the oven from 40° to 135° C. in 35 minutes followed by isothermal heating at 135° C. for 10 minutes. The dry thickness of the CTL was 23.2 micrometers determined from the weight applied to a known area.

The spray fabricated completed devices were charge-erased cycled using the environmental cyclic scanner at ambient RH (35%), low RH (<5%), and at high RH (70%). The charge-erase cyclic data for two of these devices at various RH testing conditions is described below.

TABLE Q

| Device No. | % RH | X Cycles | $V_o(1)$ | $V_o(X)$ | $V_R(1)$ | $V_R(X)$ |
|---|---|---|---|---|---|---|
| IXa | 35 | 1200 | 881 | 895 | 7 | 3 |
| | <5 | 200 | 960 | 950 | 10 | 9 |
| | 70 | 3200 | 876 | 950 | 5 | 30 |
| | <5 | 3000 | 920 | 870 | 15 | 15 |
| IXb | 35 | 3400 | 909 | 942 | 5 | 3 |

Device XIVa was charge-erase tested under the indicated relative humidity sequence allowing considerable (>16 hours) equilibration time at the next RH condition prior to charge-erase testing at that new RH condition. Device XIVa maintained its high charging level and low residual voltage ($V_R$) at all relative humidities used in this test. These results indicate that hole injection from the titanium conductive layer has been substantially blocked by the high molecular weight P(HEMA) blocking layer and that charge trapping remains low (low $V_R$) with repeated xerographic cycling.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a supporting substrate having an electrically conductive surface comprising an electrically conductive charge injecting material, a charge blocking layer comprising a water insoluble high molecular weight unmodified hydroxy methacrylate polymer having a weight average molecular weight of at least about 400,000, and at least one photoconductive layer, wherein said blocking layer having a surface resistivity greater than about $10^{10}$ ohms/square and wherein said water insoluble high molecular weight unmodified hydroxy methacrylate polymer is a polymeric reaction product consisting essentially of one or more monomers having the following structure:

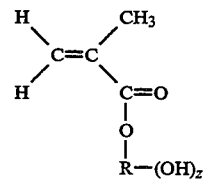

wherein

R is a linear or branched saturated aliphatic hydrocarbon group containing 1 to 6 carbon atoms, and z is 1 to 6.

2. An electrophotographic imaging member according to claim 1 wherein said water insoluble high molecular weight hydroxy methacrylate polymer is represented by the following formula:

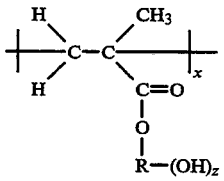

wherein x represents sufficient repeat units for a weight average molecular weight between about 400,000 and about 5,000,000, R is a linear or branched saturated aliphatic hydrocarbon group containing 1 to 6 carbon atoms, and z is 1 to 6.

3. An electrophotographic imaging member according to claim 2 wherein said water insoluble high molecular weight unmodified hydroxy methacrylate polymer has a weight average molecular weight of between about 600,000 and about 5,000,000.

4. An electrophotographic imaging member according to claim 2 wherein said charge blocking layer comprises a clear blend of said water insoluble high molecular weight unmodified hydroxy methacrylate polymer and at least one other miscible and water insoluble high molecular weight unmodified hydroxy methacrylate polymer.

5. An electrophotographic imaging member according to claim 1 wherein said water insoluble high molecular weight unmodified hydroxy methacrylate polymer is represented by the following formula:

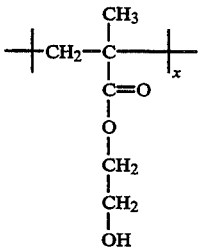

wherein x represents sufficient repeat units for a weight average molecular weight between about 400,000 and about 5,000,000.

6. An electrophotographic imaging member according to claim 5 wherein said blocking layer has a thickness between about 0.8 micrometer and about 1 micrometer.

7. An electrophotographic imaging member according to claim 1 wherein said water insoluble high molecular weight unmodified hydroxy methacrylate polymer has a weight average molecular weight of between about 400,000 and about 5,000,000.

8. An electrophotographic imaging member according to claim 1 wherein said water insoluble high molecular weight unmodified hydroxy methacrylate polymer has a weight average molecular weight of between about 950,000 and about 5,000,000.

9. An electrophotographic imaging member according to claim 1 wherein said electrically conductive charge injecting material is a nonmetallic material.

10. An electrophotographic imaging member according to claim 1 wherein said electrically conductive surface comprises carbon black impregnated polyvinyl fluoride and said blocking layer has a thickness between about 0.05 micrometer and about 8 micrometers.

11. An electrophotographic imaging member according to claim 2 wherein said blocking layer has a thickness between about 0.3 micrometer and about 1.5 micrometers.

12. An electrophotographic imaging member according to claim 1 wherein said water insoluble high molecular weight unmodified hydroxy methacrylate polymer is a homopolymer.

13. An electrophotographic imaging member according to claim 1 wherein said photoconductive layer comprises a charge generating layer and a charge transport layer.

14. An electrophotographic imaging member according to claim 1 wherein said electrically conductive surface comprises a hole injecting material.

15. An electrophotographic imaging member according to claim 14 wherein said electrically conductive surface comprises copper iodide.

16. An electrophotographic imaging member according to claim 1 wherein the resistivity of said electrically conductive surface is less than about $10^8$ ohms/square.

17. An electrophotographic imaging member according to claim 1 wherein an adhesive layer is sandwiched between said charge blocking layer and said photoconductive layer.

18. An electrophotographic imaging member according to claim 17 wherein said adhesive layer comprises poly-4-vinylpyridine hydrogen bonded to said hydroxy methacrylate polymer.

19. An electrophotographic imaging member according to claim 1 wherein said water insoluble high molecular weight unmodified hydroxy methacrylate polymer is cross-linked and has a weight average molecular weight of at least about 800,000.

20. An electrophotographic imaging process comprising providing an electrophotographic imaging member having an imaging surface, said electrophotographic imaging member comprising a supporting substrate having an electrically conductive surface comprising an electrically conductive charge injecting material, a charge blocking layer comprising a water insoluble high molecular weight unmodified hydroxy methacrylate polymer having a weight average molecular weight of at least about 400,000, and at least one photoconductive layer, wherein said blocking layer having a surface resistivity greater than about $10^{10}$ ohms/square and wherein said water insoluble high molecular weight unmodified hydroxy methacrylate polymer is a polymeric reaction product consisting essentially of one or more monomers having the following structure:

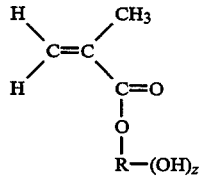

wherein

R is a linear or branched saturated aliphatic hydrocarbon group containing 1 to 6 carbon atoms and z is 1 to 6, depositing a uniform electrostatic charge of at least about 20 volts/micrometer on said imaging surface, exposing said imaging member to activating radiation in image configuration to form an electrostatic latent image, contacting said imaging surface with marking particles to form a marking particle image on said imaging surface in conformance with said electrostatic latent image, transferring said marking particle image to a receiving member, and repeating said depositing, exposing, contacting and transferring steps at least once.

21. A process for preparing an electrophotographic imaging member comprising providing a supporting substrate having an electrically conductive surface comprising an electrically conductive charge injecting material, forming a dry, continuous charge blocking layer comprising a water insoluble high molecular weight unmodified hydroxy methacrylate polymer having a weight average molecular weight of at least about 400,000 and having a surface resistivity greater than about $10^{10}$ ohms/square on said electrically conductive surface, forming at least one photoconductive layer on said charge blocking layer, said water insoluble high molecular weight unmodified hydroxy methacrylate polymer being a polymeric reaction product consisting essentially of at least one monomer having the following structure:

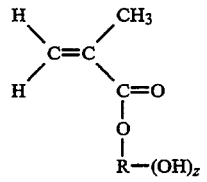

wherein

R is a linear or branched saturated aliphatic hydrocarbon group containing 1 to 6 carbon atoms and z is 1 to 6, said electrically conductive surface comprising a polymer that is soluble in a solvent in which said water insoluble high molecular weight unmodified hydroxy methacrylate polymer having a weight average molecular weight of at least about 400,000 is substantially insoluble, and applying at least one coating solution subsequent to forming said blocking layer, said coating solution comprising said solvent.

22. A process for preparing an electrophotographic imaging member according to claim 21 including wherein said forming of at least one photoconductive layer comprises applying a mixture of photoconductive particles dispersed in a solution of a film forming polymer dissolved in at least one solvent to form a coating and drying said coating to form a dry photoconductive layer.

23. A process for preparing an electrophotographic imaging member according to claim 21 including cross-linking said water insoluble high molecular weight unmodified hydroxy methacrylate polymer having a weight average molecular weight of at least about 400,000 while forming said dry, continuous charge blocking layer on said electrically conductive surface.

* * * * *